US008992706B2

(12) United States Patent
Oishi

(10) Patent No.: US 8,992,706 B2
(45) Date of Patent: Mar. 31, 2015

(54) COPPER ALLOY SHEET, AND METHOD OF PRODUCING COPPER ALLOY SHEET

(71) Applicants: Mitsubishi Shindoh Co., Ltd., Tokyo (JP); Mitsubishi Materials Corporation, Tokyo (JP)

(72) Inventor: Keiichiro Oishi, Osaka (JP)

(73) Assignees: Mitsubishi Shindoh Co., Ltd., Tokyo (JP); Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 14/098,378

(22) Filed: Dec. 5, 2013

(65) Prior Publication Data

US 2014/0174611 A1 Jun. 26, 2014

Related U.S. Application Data

(62) Division of application No. PCT/JP2012/073641, filed on Sep. 14, 2012.

(30) Foreign Application Priority Data

Sep. 16, 2011 (JP) ..... P2011-203451

(51) Int. Cl.
*C22F 1/08* (2006.01)
*C22C 9/04* (2006.01)
(Continued)

(52) U.S. Cl.
CPC ... *C22C 9/04* (2013.01); *B21B 1/22* (2013.01); *B21B 3/00* (2013.01); *C22F 1/08* (2013.01); *H01B 1/026* (2013.01); *C22F 1/00* (2013.01)
USPC ..... 148/681; 148/433

(58) Field of Classification Search
CPC ..... C22F 1/08
USPC ..... 148/681
See application file for complete search history.

(56) References Cited

U.S. PATENT DOCUMENTS

2009/0224379 A1 9/2009 Miwa et al.
2010/0047112 A1 * 2/2010 Fugono et al. ..... 420/470
(Continued)

FOREIGN PATENT DOCUMENTS

JP 63-161135 A 7/1988
JP 01-189805 A 7/1989
(Continued)

OTHER PUBLICATIONS

E. O. Hall et al., The Deformation and Ageing of Mild Steel, Proc. Phys. Soc. London, 64 (1951), pp. 747-753.
(Continued)

*Primary Examiner* — Jie Yang
(74) *Attorney, Agent, or Firm* — Griffin & Szipl, P.C.

(57) ABSTRACT

One aspect of this method of producing a copper alloy sheet includes: a hot rolling process; a cold rolling process; a recrystallization heat treatment process; and a finish cold rolling process in this order, wherein a hot rolling initiation temperature is 800° C. to 940° C., a cooling rate from a temperature after final rolling or 650° C. to 350° C. is 1° C./second or more, and a cold working rate is 55% or more. In the recrystallization heat treatment process, $550 \leq Tmax \leq 790$, $0.04 \leq tm \leq 2$, and $460 \leq \{Tmax - 40 \times tm^{-1/2} - 50 \times (1 - RE/100)^{1/2}\} \leq 580$ are fulfilled, in which Tmax is the highest arrival temperature, tm (min) is a retention time in a temperature range from a temperature lower than the highest arrival temperature by 50° C. to the highest arrival temperature, and RE (%) is a cold working rate.

6 Claims, 1 Drawing Sheet

(51) Int. Cl.

| | |
|---|---|
| ***B21B 1/22*** | (2006.01) |
| ***B21B 3/00*** | (2006.01) |
| ***H01B 1/02*** | (2006.01) |
| *C22F 1/00* | (2006.01) |

(56) References Cited

U.S. PATENT DOCUMENTS

| | | | | |
|---|---|---|---|---|
| 2011/0265917 | A1* | 11/2011 | Oishi | 148/501 |
| 2014/0166164 | A1* | 6/2014 | Oishi et al. | 148/681 |

FOREIGN PATENT DOCUMENTS

| | | | |
|---|---|---|---|
| JP | 06-184679 | A | 7/1994 |
| JP | 2000-087158 | A | 3/2000 |
| JP | 2002-530523 | A | 9/2002 |
| JP | 2002-294368 | A | 10/2002 |
| JP | 2006-283060 | A | 10/2006 |
| JP | 2007-056365 | A | 3/2007 |
| JP | 2007-100111 | A | 4/2007 |
| JP | 2008231492 | A | 10/2008 |
| JP | 2009242822 | A | 10/2009 |
| WO | 00/29632 | A1 | 5/2000 |
| WO | WO 2010079707 | A1 * | 7/2010 |

OTHER PUBLICATIONS

N. J. Petch et al., The Cleavage Strength of Polycrystals, Journal of the Iron and Steel Institute, 174 (1953), p. 25-28.

Office Action issued in co-pending related U.S. Appl. No. 14/124,224 on Aug. 21, 2014.

International Search Report issued in related application PCT/JP2012/073630, completed Nov. 15, 2012 and mailed Dec. 4, 2012.

Notice of Allowance issued in related Japanese application 2013-502309, completed May 27, 2013 and mailed Jun. 4, 2013.

Office Action issued in co-pending related U.S. Appl. No. 14/163,932, on Oct. 2, 2014.

* cited by examiner

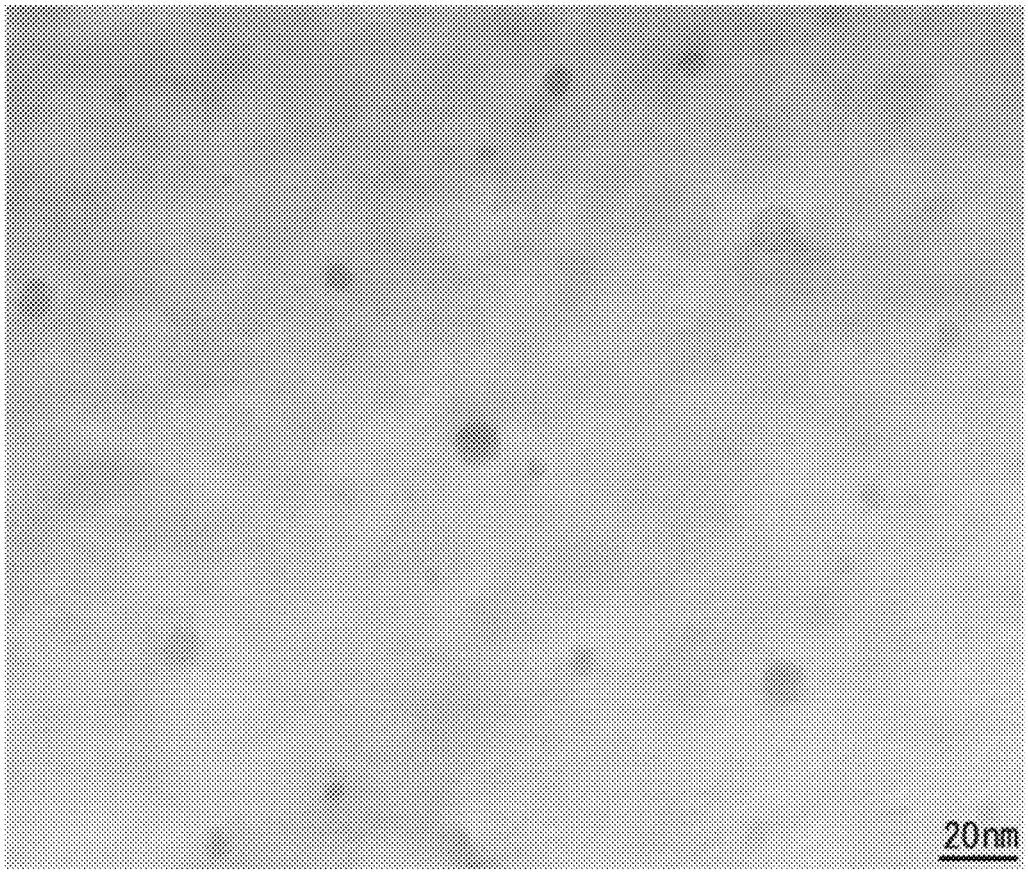
20nm

COPPER ALLOY SHEET, AND METHOD OF PRODUCING COPPER ALLOY SHEET

This is a Divisional application in the U.S. of International Patent Application No. PCT/JP2012/073641 filed Sep. 14, 2012, which claims priority on Japanese Patent Application No. P2011-203451, filed Sep. 16, 2011. The entire disclosures of the above patent applications are hereby incorporated by reference.

TECHNICAL FIELD

The present invention relates to a copper alloy sheet and a method of producing a copper alloy sheet. Particularly, the invention relates to a copper alloy sheet excellent in tensile strength, proof stress, conductivity, bending workability, stress corrosion cracking resistance, and stress relaxation characteristics, and a method of producing a copper alloy sheet.

Priority is claimed on Japanese Patent Application No. 2011-203451, filed Sep. 16, 2011, the content of which is incorporated herein by reference.

BACKGROUND ART

As a constituent material of a connector, a terminal, a relay, a spring, a switch, and the like which are used in electrical components, electronic components, vehicle components, communication apparatuses, electronic and electric apparatuses, and the like, a copper alloy sheet having high conductivity and high strength has been used. However, along with recent reduction in size and weight, and higher performance of apparatuses, a very strict characteristics improvement has been also required for the constituent material that is used for the apparatuses. For example, a very thin sheet is used for a spring contact portion of a connector. However, it is required for a high-strength copper alloy constituting the very thin sheet to have high strength, and a high degree of balance between elongation and strength so as to realize small thickness. Furthermore, it is also required for the copper alloy sheet to be excellent in productivity and economic efficiency, and to have no problem in conductivity, corrosion resistance (stress corrosion cracking resistance, dezincification corrosion resistance, migration resistance), stress relaxation characteristics, solderability, and the like.

In addition, in the constituent material of a connector, a terminal, a relay, a spring, a switch, and the like which are used in electrical components, electronic components, vehicle components, communication apparatuses, electronic and electric apparatuses, and the like, a component and a portion in which relatively high strength or relatively high conductivity are necessary are present due to a demand for small thickness on the assumption that elongation and bending workability are excellent. However, the strength and the conductivity are characteristics that conflict with each other, and thus when strength is improved, conductivity generally decreases. Among these, there is present a component which is a high-strength material, and for which relatively higher conductivity (32% IACS or more, for example, approximately 36% IACS) is required at tensile strength, for example, of 500 N/mm$^2$ or more. In addition, there is also present a component for which further excellent stress relaxation characteristics and heat resistance are required, for example, at a site at which a use environment temperature is high such as a site close to an engine room of a vehicle.

As a high-conductivity and high-strength copper alloy, generally, beryllium copper, phosphor bronze, nickel silver, brass, and Sn-added brass are known in the related art, but these general high-strength copper alloys have the following problem, and thus these alloys may not meet the above-described demand.

Beryllium copper has the highest strength among copper alloys, but beryllium is very harmful to the human body (particularly, in a melted state, it is very dangerous even in an infinitesimal amount of beryllium vapor). Therefore, waste disposal (particularly, incineration disposal) of members formed from beryllium copper or products including the members is difficult, and an initial cost necessary for melting facilities used for production is very high. Accordingly, there is a problem of economic efficiency including a production cost together with a solution treatment at the final production stage to obtain predetermined characteristics.

Phosphor bronze and nickel silver are poor in hot workability, and production thereof by hot rolling is difficult. Therefore, phosphor bronze and nickel silver are generally produced by horizontal type continuous casting. Accordingly, productivity is poor, energy cost is high, and yield is also poor. In addition, expensive Sn and Ni are contained in phosphor bronze for springs or nickel silver for springs, which are representative high-strength kinds, in a large amount, and thus conductivity is poor, and economic efficiency is also problematic.

Brass, and brass to which only Sn is added are inexpensive. However, these do not have satisfactory strength, and are poor in stress relaxation characteristics and conductivity. In addition, there is a problem of corrosion resistance (stress corrosion and dezincification corrosion), and thus these are not suitable for a constituent member of products for realizing reduction in size and higher performance as described above.

Accordingly, such a general high-conductivity and high-strength copper alloy is not satisfactory as a constituent material of components of various kinds of apparatuses in which size and weight tend to be reduced, and performance tends to increase as described above, and development of a new high-conductivity and high-strength copper alloy has been strongly demanded.

As an alloy for satisfying the demand for the high-conductivity and high strength as described above, for example, a Cu—Zn—Sn alloy as disclosed in Patent Document 1 is known. However, even in the alloy related to Patent Document 1, conductivity and strength are not sufficient.

RELATED ART DOCUMENT

Patent Document

[Patent Document 1] Japanese Unexamined Patent Application Publication No. 2007-56365

DISCLOSURE OF THE INVENTION

Problem that the Invention is to Solve

The invention has been made to solve the above-described problem in the related art, and an object thereof is to provide a copper alloy sheet which is excellent in tensile strength, proof stress, conductivity, bending workability, stress corrosion cracking resistance, and stress relaxation characteristics.

Means for Solving the Problem

The present inventors have given attention to a relational expression of Hall-Petch (refer to E. O. Hall, Proc. Phys. Soc. London. 64 (1951) 747. and N. J. Petch, J. Iron Steel Inst. 174

(1953) 25.) in which 0.2% proof stress (strength when permanent strain becomes 0.2%, and hereinafter, may be referred to as simply "proof stress") increases proportionally to D (grain size) to the power of $-\frac{1}{2}$ ($D^{-1/2}$), and have considered that the high-strength copper alloy capable of satisfying the above-described present-day demand may be obtained by making a crystal grain fine, and they have performed various kinds of research and experiments with respect to refinement of crystal grain.

As a result, the present inventors have obtained the following findings.

When a copper alloy is recrystallized depending on an additive element, the refinement of crystal grain may be realized. When the crystal grain (recrystallized grain) is made fine to a certain degree or lower, strength mainly including tensile strength and proof stress may be significantly improved. That is, as an average grain size decreases, strength also increases.

Specifically, the present inventors have performed various experiments with respect to an effect of the additive element on the refinement of the crystal grain. According to the experiments, they have clarified the following facts.

Addition of Zn and Sn to Cu has an effect of increasing recrystallization nucleation sites. Furthermore, addition of P, Co, and Ni to a Cu—Zn—Sn alloy has an effect of suppressing grain growth. Accordingly, the present inventors have clarified that a Cu—Zn—Sn—P—Co type alloy, a Cu—Zn—Sn—P—Ni type alloy, and a Cu—Zn—Sn—P—Co—Ni type alloy, which have fine crystal grains, may be obtained by using the effects.

That is, one of main causes of the increase in the recrystallization nucleation sites is considered as follows. Due to addition of bivalent Zn and tetravalent Sn, stacking fault energy is lowered. Suppression of grain growth to maintain generated fine recrystallized grain as is in a fine state is considered to be caused by generation of fine precipitates due to addition of P, Co, and Ni. However, the balance between strength, elongation, and bending workability is not obtained only with the aim of ultra-refinement of a recrystallized grain. It has been proved that a crystal grain refinement region in a range of a certain degree with room for refinement of recrystallized grain is good to maintain the balance. With regard to refinement or ultra-refinement of the crystal grain, the minimum grain size is 0.010 mm in a standard photograph described in JIS H 0501. From this, when having an average grain size of approximately 0.008 mm or less, it may be said that the crystal grain is made fine, and when having an average grain size of 0.004 mm (4 micrometers) or less, it may be said that the crystal grain is made ultra-fine.

The invention has been completed on the basis of these findings of the present inventors. That is, to solve the problem, the following aspects are provided.

According to an aspect of the invention, there is provided a copper alloy sheet that is produced by a production process including a finish cold rolling process at which a copper alloy material is cold-rolled. An average grain size of the copper alloy material is 2.0 μm to 8.0 μm, circular or elliptical precipitates are present in the copper alloy material, and an average particle size of the precipitates is 4.0 nm to 25.0 nm, or a percentage of the number of precipitates having a particle size of 4.0 nm to 25.0 nm makes up 70% or more of the precipitates. The copper alloy sheet contains 4.5% by mass to 12.0% by mass of Zn, 0.40% by mass to 0.90% by mass of Sn, and 0.01% by mass to 0.08% by mass of P, as well as 0.005% by mass to 0.08% by mass of Co and/or 0.03% by mass to 0.85% by mass of Ni, the remainder being Cu and unavoidable impurities. [Zn], [Sn], [P], [Co], and [Ni] satisfy a relationship of $11 \leq [Zn]+7\times[Sn]+15\times[P]+12\times[Co]+4.5\times[Ni] \leq 17$ (here, [Zn], [Sn], [P], [Co], and [Ni] represent the contents (% by mass) of Zn, Sn, P, Co, and Ni, respectively).

In the invention, a copper alloy material having crystal grains having a predetermined grain size, and precipitates having a predetermined particle size is subjected to the cold rolling. However, even when the cold rolling is performed, crystal grains and precipitates before the rolling may be recognized. Accordingly, the grain size of the crystal grains and the particle size of the precipitates before the rolling may be measured after the rolling. In addition, even when the crystal grains and the precipitates are rolled, the volume thereof is the same, and thus the average grain size of the crystal grains and the average particle size of the precipitate do not vary between before and after the cold rolling.

In addition, the circular or elliptical precipitates include not only a perfect circular or elliptical shape but also a shape approximate to the circular or elliptical shape as an object.

In addition, in the following description, the copper alloy material is appropriately referred to as a rolled sheet.

According to the invention, the average grain size of the crystal grains of the copper alloy material and the average particle size of the precipitates before the finish cold rolling are within a predetermined preferable range, and thus the copper alloy is excellent in tensile strength, proof stress, conductivity, bending workability, stress corrosion cracking resistance, and the like.

In addition, according to another aspect of the invention, there is provided a copper alloy sheet that is produced by a production process including a finish cold rolling process at which a copper alloy material is cold-rolled. An average grain size of the copper alloy material is 2.5 μm to 7.5 μm, circular or elliptical precipitates are present in the copper alloy material, and an average particle size of the precipitates is 4.0 nm to 25.0 nm, or a percentage of the number of precipitates having a particle size of 4.0 nm to 25.0 nm makes up 70% or more of the precipitates. The copper alloy sheet contains 4.5% by mass to 10.0% by mass of Zn, 0.40% by mass to 0.85% by mass of Sn, and 0.01% by mass to 0.08% by mass of P, as well as 0.005% by mass to 0.05% by mass of Co and/or 0.35% by mass to 0.85% by mass of Ni, the remainder being Cu and unavoidable impurities. [Zn], [Sn], [P], [Co], and [Ni] satisfy a relationship of $11 \leq [Zn]+7\times[Sn]+15\times[P]+12\times[Co]+4.5\times[Ni] \leq 16$ (here, [Zn], [Sn], [P], [Co], and [Ni] represent the contents (% by mass) of Zn, Sn, P, Co, and Ni, respectively), and in a case where the content of Ni is 0.35% by mass to 0.85% by mass, $8 \leq [Ni]/[P] \leq 40$ is satisfied.

According to the invention, the average grain size of the crystal grains of the copper alloy material and the average particle size of the precipitates before the finish cold rolling are within a predetermined preferable range, and thus the copper alloy is excellent in tensile strength, proof stress, conductivity, bending workability, stress corrosion cracking resistance, and the like.

In addition, in a case where the content of Ni is 0.35% by mass to 0.85% by mass, $8 \leq [Ni]/[P] \leq 40$ is satisfied, and thus a stress relaxation rate becomes satisfactory.

In addition, according to still another aspect of the invention, there is provided a copper alloy sheet that is produced by a production process including a finish cold rolling process at which a copper alloy material is cold-rolled. An average grain size of the copper alloy material is 2.0 μm to 8.0 μm, circular or elliptical precipitates are present in the copper alloy material, and an average particle size of the precipitates is 4.0 nm to 25.0 nm, or a percentage of the number of precipitates having a particle size of 4.0 nm to 25.0 nm makes up 70% or more of the precipitates. The copper alloy sheet contains 4.5% by mass to 12.0% by mass of Zn, 0.40% by mass to 0.90% by mass of Sn, 0.01% by mass to 0.08% by mass of P, and 0.004% by mass to 0.04% by mass of Fe, as well as 0.005% by mass to 0.08% by mass of Co and/or 0.03% by mass to 0.85% by mass of Ni, the remainder being Cu and unavoidable impurities. [Zn], [Sn], [P], [Co], and [Ni] satisfy a relationship of $11 \leq [Zn]+7\times[Sn]+15\times[P]+12\times[Co]+4.5\times[Ni] \leq 17$ (here, [Zn], [Sn], [P], [Co], and [Ni] represent the contents (% by mass) of Zn, Sn, P, Co, and Ni, respectively) and [Co] and [Fe] satisfy a relationship of $[Co]+[Fe] \leq 0.08$ (here, [Co] and [Fe] represent the contents (% by mass) of Co and Fe, respectively).

Since 0.004% by mass to 0.04% by mass of Fe is contained, crystal grains are made fine, and thus strength may be increased.

In the three kinds of copper alloy sheets according to the invention, when conductivity is set as C (% IACS), and tensile strength and elongation in a direction making an angle of 0° with a rolling direction are set as Pw ($N/mm^2$) and L (%), respectively, it is preferable that after the finish cold rolling process, $C \geq 32$, $Pw \geq 500$, and $3200 \leq [Pw\times\{(100+L)/100\}\times C^{1/2}] \leq 4000$. In addition, it is preferable that a ratio of tensile strength in a direction making an angle of 0° with the rolling direction to tensile strength in a direction making an angle of 90° with the rolling direction be 0.95 to 1.05. In addition, it is preferable that a ratio of proof stress in a direction making an angle of 0° with the rolling direction to proof stress in a direction making an angle of 90° with the rolling direction be 0.95 to 1.05.

The balance between the conductivity, tensile strength, and elongation is excellent, and there is no directionality in the tensile strength and the proof stress, and thus the copper alloy sheets are suitable for a constituent material and the like of a connector, a terminal, a relay, a spring, a switch, and the like.

In the three kinds of copper alloy sheets according to the invention, it is preferable that the production process include a recovery heat treatment process after the finish cold rolling process.

Since the recovery heat treatment is performed, the stress relaxation rate, the spring deflection limit, and the elongation are improved.

In the three kinds of copper alloy sheets which are subjected to the recovery heat treatment according to the invention, when conductivity is set as C (% IACS), and tensile strength and elongation in a direction making an angle of 0° with a rolling direction are set as Pw ($N/mm^2$) and L (%), respectively, it is preferable that after the recovery heat treatment process, $C \geq 32$, $Pw \geq 500$, and $3200 \leq [Pw\times\{(100+L)/100\}\times C^{1/2}] \leq 4000$. In addition, it is preferable that a ratio of tensile strength in a direction making an angle of 0° with the rolling direction to tensile strength in a direction making an angle of 90° with the rolling direction be 0.95 to 1.05. In addition, it is preferable that a ratio of proof stress in a direction making an angle of 0° with the rolling direction to proof stress in a direction making an angle of 90° with the rolling direction be 0.95 to 1.05.

Since the balance between the conductivity and tensile strength is excellent, and there is no directionality in the tensile strength and the proof stress, the copper alloy sheets are excellent as a copper alloy.

According to still another aspect of the invention, there is provided a method of producing the three kinds of copper alloy sheets according to the invention. The production method includes a hot rolling process, a cold rolling process, a recrystallization heat treatment process, and the finish cold rolling process in this order. A hot rolling initiation temperature of the hot rolling process is 800° C. to 940° C., and a cooling rate of a copper alloy material in a temperature region from a temperature after final rolling or 650° C. to 350° C. is 1° C./second or more. A cold working rate in the cold rolling process is 55% or more. The recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step. In the recrystallization heat treatment process, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and a cold working rate at the cold rolling process is set as RE (%), $550 \leq Tmax \leq 790$, $0.04 \leq tm \leq 2$, and $460 \leq \{Tmax-40\times tm^{-1/2}-50\times(1-RE/100)^{1/2}\} \leq 580$.

In addition, between the hot rolling process and the cold rolling process, a pair of a cold rolling process and an annealing process may be performed once or plural times depending on the sheet thickness of the copper alloy sheets.

According to still another aspect of the invention, there is provided a method of producing the three kinds of copper alloy sheets which are subjected to the recovery heat treatment according to the invention. The method includes a hot rolling process, a cold rolling process, a recrystallization heat treatment process, the finish cold rolling process, and the recovery heat treatment process in this order. A hot rolling initiation temperature of the hot rolling process is 800° C. to 940° C., and a cooling rate of a copper alloy material in a temperature region from a temperature after final rolling or 650° C. to 350° C. is 1° C./second or more. A cold working rate in the cold rolling process is 55% or more. The recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step. In the recrystallization heat treatment process, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and a cold working rate at the cold rolling process is set as RE (%), $550 \leq Tmax \leq 790$, $0.04 \leq tm \leq 2$, and $460 \leq \{Tmax-40\times tm^{-1/2}-50\times(1-RE/100)^{1/2}\} \leq 580$. The recovery heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step. In the recovery heat treatment process, when the highest arrival temperature of the copper alloy material is set as Tmax2 (° C.), a retention time in a temperature range from a temperature lower than the highest arrival temperature of the copper alloy material by 50° C. to the highest arrival temperature is set as tm2 (min), and a cold working rate at the finish cold rolling process is set as RE2(%), $160 \leq Tmax2 \leq 650$, $0.02 \leq tm2 \leq 200$, and $100 \leq \{Tmax2-40\times tm2^{-1/2}-50\times(1-RE2/100)^{1/2}\} \leq 360$.

In addition, between the hot rolling process and the cold rolling process, a pair of a cold rolling process and an annealing process may be performed once or plural times depending on the sheet thickness of the copper alloy sheets.

Advantage of the Invention

According to the invention, tensile strength, proof stress, conductivity, bending workability, stress corrosion cracking resistance, and the like of the copper alloy sheet are excellent.

BRIEF DESCRIPTION OF THE DRAWINGS

FIG. 1 is a transmission electron microscope photograph of a copper alloy sheet of an alloy No. 2 (test No. T15).

BEST MODE FOR CARRYING OUT THE INVENTION

A copper alloy sheet according to an embodiment of the invention will be described.

In the specification, when describing an alloy composition, an element symbol in parentheses like [Cu] represents the content value (% by mass) of the corresponding element. In addition, a plurality of calculating expressions are suggested in the specification using an expression method of the content value. However, the content of 0.001% by mass or less of Co, and the content of 0.01% by mass or less of Ni have little effect on characteristics of the copper alloy sheet. Accordingly, in respective calculation expressions to be described later, the content of 0.001% by mass or less of Co, and the content of 0.01% by mass or less of Ni are calculated as 0.

In addition, with regard to unavoidable impurities, the contents of the unavoidable impurities also have little effect on the characteristics of the copper alloy sheet, and thus the contents of the unavoidable impurities are not included in the respective calculation expression to be described later. For example, Cr of 0.01% by mass or less is regarded as an unavoidable impurity.

In addition, in this specification, as an index indicating the balance of the contents of Zn, Sn, P, Co, and Ni, a composition index f1 is determined as follows.

$$\text{A composition index } f1=[Zn]+7\times[Sn]+15\times[P]+12\times[Co]+4.5\times[Ni]$$

In addition, in this specification, as an index indicating heat treatment conditions in a recrystallization heat treatment process, and a recovery heat treatment process, a heat treatment index It is determined as follows.

When the highest arrival temperature of the copper alloy material during each heat treatment is set as Tmax (° C.), a retention time in a temperature region from a temperature lower than the highest arrival temperature of the copper alloy material by 50° C. to the highest arrival temperature is set as tm (min), and a cold working rate of cold rolling performed between each heat treatment (a recrystallization heat treatment process or a recovery heat treatment process) and a process (hot rolling or heat treatment) which is accompanied with recrystallization and which is performed before each heat treatment is set as RE (%), the heat treatment index It is determined as follows.

$$\text{Heat treatment index } It=T\max-40\times tm^{1/2}-50\times(1-RE/100)^{1/2}$$

In addition, as an index indicating a balance between conductivity, tensile strength, and elongation, a balance index f2 is determined as follows.

When the conductivity is set as C (% IACS), the tensile strength is set as Pw (N/mm$^2$), and the elongation is set as L (%), the balance index f2 is determined as follows.

$$\text{Balance index } f2=Pw\times\{(100+L)/100\}\times C^{1/2}$$

That is, the balance index f2 is the product of Pw and $\{(100+L)/100\}\times C^{1/2}$.

A copper alloy sheet according to a first embodiment is a copper alloy sheet in which a copper alloy material is subjected to finish cold rolling. An average grain size of the copper alloy material is 2.0 μm to 8.0 μm. Circular or elliptical precipitates are present in the copper alloy material. An average particle size of the precipitates is 4.0 nm to 25.0 nm, or a percentage of the number of precipitates having a particle size of 4.0 nm to 25.0 nm makes up 70% or more of the precipitates. In addition, the copper alloy sheet contains 4.5% by mass to 12.0% by mass of Zn, 0.40% by mass to 0.90% by mass of Sn, and 0.01% by mass to 0.08% by mass of P, as well as 0.005% by mass to 0.08% by mass of Co and/or 0.03% by mass to 0.85% by mass of Ni, the remainder being Cu and unavoidable impurities. [Zn], [Sn], [P], [Co], and [Ni] satisfy a relationship of $11\leq[Zn]+7\times[Sn]+15\times[P]+12\times[Co]+4.5\times[Ni]\leq17$ (here, [Zn], [Sn], [P], [Co], and [Ni] represent the contents (% by mass) of Zn, Sn, P, Co, and Ni, respectively).

Since the average grain size of the crystal grains of the copper alloy material and the average particle size of the precipitates before the cold rolling are within a predetermined preferable range, the copper alloy sheet is excellent in tensile strength, proof stress, conductivity, bending workability, stress corrosion cracking resistance, and the like.

Preferable ranges of the average grain size of the crystal grains and the average particle size of the precipitates will be described later.

A copper alloy sheet according to a second embodiment is a copper alloy sheet in which a copper alloy material is subjected to the finish cold rolling. The average grain size of the copper alloy material is 2.5 μm to 7.5 μm. Circular or elliptical precipitates are present in the copper alloy material. An average particle size of the precipitates is 4.0 nm to 25.0 nm, or a percentage of the number of precipitates having a particle size of 4.0 nm to 25.0 nm makes up 70% or more of the precipitates. In addition, the copper alloy sheet contains 4.5% by mass to 10.0% by mass of Zn, 0.40% by mass to 0.85% by mass of Sn, and 0.01% by mass to 0.08% by mass of P, as well as 0.005% by mass to 0.05% by mass of Co and/or 0.35% by mass to 0.85% by mass of Ni, the remainder being Cu and unavoidable impurities. [Zn], [Sn], [P], [Co], and [Ni] satisfy a relationship of $11\leq[Zn]+7\times[Sn]+15\times[P]+12\times[Co]+4.5\times[Ni]\leq16$ (here, [Zn], [Sn], [P], [Co], and [Ni] represent the contents (% by mass) of Zn, Sn, P, Co, and Ni, respectively), and in a case where the content of Ni is 0.35% by mass to 0.85% by mass, $8\leq[Ni]/[P]\leq40$ is satisfied.

Since the average grain size of the crystal grains of the copper alloy material and the average particle size of the precipitates before the cold rolling are within a predetermined preferable range, the copper alloy sheet is excellent in tensile strength, proof stress, conductivity, bending workability, stress corrosion cracking resistance, and the like. In addition, in a case where the content of Ni is 0.35% by mass to 0.85% by mass, $8\leq[Ni]/[P]\leq40$ is satisfied, and thus a stress relaxation rate is satisfactory.

A copper alloy sheet according to a third embodiment is a copper alloy sheet in which a copper alloy material is subjected to finish cold rolling. An average grain size of the copper alloy material is 2.0 μm to 8.0 μm. Circular or elliptical precipitates are present in the copper alloy material. An average particle size of the precipitates is 4.0 nm to 25.0 nm, or a percentage of the number of precipitates having a particle size of 4.0 nm to 25.0 nm makes up 70% or more of the precipitates. The copper alloy sheet contains 4.5% by mass to 12.0% by mass of Zn, 0.40% by mass to 0.90% by mass of Sn, 0.01% by mass to 0.08% by mass of P, and 0.004% by mass to 0.04% by mass of Fe, as well as 0.005% by mass to 0.08% by mass of Co and/or 0.03% by mass to 0.85% by mass of Ni, the remainder being Cu and unavoidable impurities. [Zn], [Sn], [P], [Co], and [Ni] satisfy a relationship of $11 \leq [Zn]+7\times[Sn]+15\times[P]+12\times[Co]+4.5\times[Ni] \leq 17$ (here, [Zn], [Sn], [P], [Co], and [Ni] represent the contents (% by mass) of Zn, Sn, P, Co, and Ni, respectively) and [Co] and [Fe] satisfy a relationship of $[Co]+[Fe] \leq 0.08$ (here, [Co] and [Fe] represent the contents (% by mass) of Co and Fe, respectively).

Since 0.004% by mass to 0.04% by mass of Fe is contained, crystal grains are made fine, and thus strength may be increased.

Next, a preferred process of producing the copper alloy sheets related the embodiments will be described.

The production process includes a hot rolling process, a first cold rolling process, an annealing process, a second cold rolling process, a recrystallization heat treatment process, and the above-described finish cold rolling process in this order. The second cold rolling process corresponds to a cold rolling process described in the attached claims. Ranges of production conditions necessary for the respective processes are set, and these ranges are referred to as setting condition ranges.

A composition of an ingot that is used in the hot rolling is adjusted in such a manner that the copper alloy sheet contains 4.5% by mass to 12.0% by mass of Zn, 0.40% by mass to 0.90% by mass of Sn, and 0.01% by mass to 0.08% by mass of P, as well as 0.005% by mass to 0.08% by mass of Co and/or 0.03% by mass to 0.85% by mass of Ni, the remainder being Cu and unavoidable impurities, and the composition index f1 is within a range of $11 \leq f1 \leq 17$. An alloy of this composition is referred to as a first alloy of the invention.

In addition, the composition of the ingot that is used in the hot rolling is adjusted in such a manner that the copper alloy sheet contains 4.5% by mass to 10.0% by mass of Zn, 0.40% by mass to 0.85% by mass of Sn, and 0.01% by mass to 0.08% by mass of P, as well as 0.005% by mass to 0.05% by mass of Co and/or 0.35% by mass to 0.85% by mass of Ni, the remainder being Cu and unavoidable impurities, the composition index f1 is within a range of $11 \leq f1 \leq 16$, and in a case where the content of Ni is 0.35% by mass to 0.85% by mass, a relationship of $8 \leq [Ni]/[P] \leq 40$ is satisfied. An alloy of this composition is referred to as a second alloy of the invention.

In addition, the composition of the ingot that is used in the hot rolling is adjusted in such a manner that the copper alloy sheet contains 4.5% by mass to 12.0% by mass of Zn, 0.40% by mass to 0.90% by mass of Sn, 0.01% by mass to 0.08% by mass of P, and 0.004% by mass to 0.04% by mass of Fe, as well as 0.005% by mass to 0.08% by mass of Co and/or 0.03% by mass to 0.85% by mass of Ni, the remainder being Cu and unavoidable impurities, and the composition index f1 is within a range of $11 \leq f1 \leq 17$, and [Co] and [Fe] satisfy a relationship of $[Co]+[Fe] \leq 0.08$ (here, [Co] and [Fe] represent the contents (% by mass) of Co and Fe, respectively). An alloy of this composition is referred to as a third alloy of the invention. The first to third alloys of the invention are collectively referred to as an alloy of the invention.

In the hot rolling process, a hot rolling initiation temperature is 800° C. to 940° C., and a cooling rate of a rolled material in a temperature region from a temperature after final rolling or 650° C. to 350° C. is 1° C./second or more.

A cold working rate in the first cold rolling process is 55% or more.

As described later, when a grain size after the recrystallization heat treatment process is set as D1, a grain size after an immediately preceding annealing process is set as D0, and a cold working rate of the second cold rolling between the recrystallization heat treatment process and the annealing process is set as RE (%), the annealing process is performed under conditions satisfying $D0 \leq D1\times4\times(RE/100)$. The conditions are as follows. In a case where the annealing process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and a cold working rate at the first cold rolling process is set as RE (%), $420 \leq Tmax \leq 800$, $0.04 \leq tm \leq 600$, and $390 \leq \{Tmax-40\times tm^{-1/2}-50\times(1-RE/100)^{1/2}\} \leq 580$.

In a case where a sheet thickness of the rolled sheet after the finish cold rolling process is large, the first cold rolling process and the annealing process may not be performed, and in a case where the sheet thickness is small, the first cold rolling process and the annealing process may be performed plural times. Whether or not to perform the first cold rolling process and the annealing process or the number of times thereof are determined according to a relationship between the sheet thickness after the hot rolling process and the sheet thickness after the finish cold rolling process.

In the second cold rolling process, a cold working rate is 55% or more.

The recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step.

Here, when the highest arrival temperature of the copper alloy material is set as Tmax (° C.), and a retention time in a temperature range from a temperature lower than the highest arrival temperature of the copper alloy material by 50° C. to the highest arrival temperature is set as tm (min), the recrystallization heat treatment process satisfies the following conditions.

(1) 550≤the highest arrival temperature Tmax≤790

(2) 0.04≤the retention time tm≤2

(3) 460≤the heat treatment index It≤580

A recovery heat treatment process may be performed after the recrystallization heat treatment process as described later, but the recrystallization heat treatment process becomes the final heat treatment allowing the copper alloy material to be recrystallized.

After the recrystallization heat treatment process, the copper alloy material has a metallographic structure in which an average grain size is 2.0 μm to 8.0 μm, circular or elliptical precipitates are present, and an average particle size of the precipitates is 4.0 nm to 25.0 nm, or a percentage of the number of precipitates having a particle size of 4.0 nm to 25.0 nm makes up 70% or more of the precipitates.

A cold working rate after the finish cold rolling process is 20% to 65%.

A recovery heat treatment process may be performed after the finish cold rolling process. In addition, Sn plating may be performed after the finish rolling for a use of the copper alloy of the invention. However, a material temperature during plating such as melting Sn plating and reflow Sn plating increases, and thus a heating process during the plating treatment may be substituted for the recovery heat treatment process.

The recovery heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step.

Here, when the highest arrival temperature of the copper alloy material is set as Tmax (° C.), and a retention time in a temperature range from a temperature lower than the highest arrival temperature of the copper alloy material by 50° C. to the highest arrival temperature is set as tm (min), the recrystallization heat treatment process satisfies the following conditions.

(1) 160≤the highest arrival temperature Tmax≤650

(2) 0.02≤the retention time tm≤200

(3) 100≤the heat treatment index It≤360

Next, the reason why the respective elements are added will be described.

Zn is a primary element constituting the invention. Zn decreases stacking fault energy at a bivalent atomic valence, increases recrystallization nucleation sites during annealing, and makes recrystallized grains fine or ultrafine. In addition, strength such as tensile strength, proof stress, and spring characteristics is improved due to solid solution of Zn without deteriorating bending workability. In addition, Zn improves heat resistance of a matrix, and stress relaxation characteristics, and improves migration resistance. A cost of Zn metal is low, and thus when a percentage of a copper alloy is lowered, there is an economical merit. It is necessary for Zn to be contained in a content of at least 4.5% by mass or more so as to exhibit the above-described effects regardless of other additive elements such as Sn, preferably 5.0% by mass or more, and still more preferably 5.5% by mass or more. On the other hand, even when Zn is contained in a content exceeding 12.0% by mass, Zn has a relationship with refinement of crystal grains and improvement of strength although this relationship depends on a relationship with other additive elements such as Sn, but a significant effect appropriate for the content is not exhibited, conductivity decreases, elongation and bending workability deteriorate, heat resistance and stress relaxation characteristics decrease, and sensitivity for stress corrosion cracking increases. The content of Zn is preferably 11.0% by mass or less, more preferably 10.0% by mass or less, and still more preferably 8.5% by mass or less. When Zn is contained within a setting range of the invention, and preferably 5.0% by mass to 8.5% by mass, heat resistance of a matrix is improved. Particularly, due to interaction with Ni, Sn, and P, stress relaxation characteristics are improved, and thus excellent bending workability, high strength, and desired conductivity are provided. Even when the content of bivalent Zn is within the above-described range, when the Zn is added alone, it is difficult to make crystal grains fine. In order to make the crystal grains fine to a predetermined grain size, it is necessary to consider the value of the composition index f1 in combination with co-addition of Sn, Ni, and P as described below. Similarly, in order to improve heat resistance, stress relaxation characteristics, and strength and spring characteristics, it is necessary to consider the value of the composition index f1 in combination with co-addition of Sn, Ni, and P as described below.

Sn is a primary element constituting the invention. Sn, which is a tetravalent element, decreases stacking fault energy, increases recrystallization nucleation sites during annealing, and makes recrystallized grains fine or ultrafine in combination with Zn being contained. Particularly, in combination with co-addition with 4.5% by mass or more of bivalent Zn, preferably 5.0% by mass or more, and still more preferably 5.5% by mass or more, the above-described effects are significantly exhibited even when a small amount of Sn is contained. In addition, Sn is solid-soluted in a matrix, improves tensile strength, proof stress, spring characteristics, and the like, improves heat resistance of the matrix, improves stress relaxation characteristics, and improves stress corrosion cracking resistance. So as to exhibit the-above described effects, it is necessary for Sn to be contained in a content of at least 0.40% by mass or more, preferably 0.45% by mass or more, and still more preferably 0.50% by mass or more. On the other hand, when Sn is contained, conductivity is deteriorated. In addition, although there is a relation with other elements such as Zn, when the content of Sn exceeds 0.90% by mass, conductivity as high as 32% IACS or more, which is generally ⅓ times the conductivity of pure copper, may not be obtained, and bending workability is decreased. The content of Sn is preferably 0.85% by mass or less, and more preferably 0.80% by mass or less.

Cu is a main element constituting the alloy of the invention, and is set as the remainder. However, to accomplish the invention, it is necessary for Cu to be contained in a content of at least 87% by mass or more, preferably 88.5% by mass or more, and still more preferably 89.5% by mass or more so as to secure conductivity and stress corrosion cracking resistance which depend on a concentration of Cu, and to maintain stress relaxation characteristics and elongation. On the other hand, it is preferable that the content of Cu be set to at least 94% by mass or less, and preferably 93% by mass or less to obtain high strength.

P, which is a pentavalent element, has an operation of making crystal grains fine and an operation of suppressing growth of recrystallized grains. However, the content of P is small, and thus the latter operation is predominant. A part of P chemically combines with Co or Ni to be described later to form precipitates, and thus the effect of suppressing growth of crystal grains may be further enhanced. To suppress the growth of the crystal grains, it is necessary that circular or elliptical precipitates be present, and an average particle size of the precipitated particles is 4.0 nm to 25.0 nm, or a percentage of the number of precipitated particles having a particle size of 4.0 nm to 25.0 nm makes up 70% or more of the precipitated particles. In precipitates that belong to this range, an operation or effect of suppressing growth of recrystallized grains during annealing is predominant compared to precipitation strengthening, and the operation or effect is different from a strengthening operation by precipitation alone. In addition, the precipitates have an effect of improving stress relaxation characteristics. In addition, in combination with Zn and Sn being contained within the range of the invention, P has an effect of significantly improving the stress relaxation characteristics, which is one subject matter of the invention, by interaction with Ni.

So as to exhibit the effect, it is necessary for P to be contained in a content of at least 0.010% by mass or more, preferably 0.015% by mass or more, and still more preferably 0.020% by mass or more. On the other hand, even when P is contained in a content exceeding 0.080% by mass, the effect of suppressing growth of recrystallized grains by the precipitates is saturated. In a case where the precipitates are excessively present, elongation and bending workability decrease. 0.070% by mass or less of P is preferable, and 0.060% by mass or less P is more preferable.

With regard to Co, a part thereof bonds to P or bonds to P and Ni to generate a compound, and the remainder of Co is solid-soluted. Co suppresses growth of recrystallized grains and improves stress relaxation characteristics. So as to exhibit the effect, it is necessary for Co to be contained in a content of 0.005% by mass or more, and preferably 0.010% by mass or more. On the other hand, even when Co is contained in a content of 0.08% by mass or more, the effect is saturated, and the effect of suppressing growth of crystal grains is excessive. Therefore, it is difficult to obtain crystal grains having a desired size, and thus conductivity decreases depending on a production process. Furthermore, since the number of precipitates increases or a particle size of precipitates becomes small, bending workability has a tendency to decrease, and directionality has a tendency to occur in mechanical properties. 0.04% by mass or less of Co is preferable, and 0.03% by mass or less of Co is more preferable.

So as to further exhibit the effect of suppressing growth of crystal grains due to Co and to reduce a decrease in conductivity to the minimum, it is necessary for [Co]/[P] to be 0.2 or more, and preferably 0.3 or more. On the other hand, the upper limit of Co is 2.5 or less, and preferably 2 or less. Particularly, in a case of Ni not being contained to be described later, it is preferable that [Co]/[P] be defined.

With regard to Ni, a part thereof bonds to P or bonds to P and Co to generate a compound, and the remainder of Ni is solid-soluted. Ni improves stress relaxation characteristics by interaction with P, Zn, and Sn which are contained in a concentration range defined in the invention, increases Young's modulus of an alloy, and suppresses growth of recrystallized grains by the compound that is generated. To exhibit the operation of suppressing growth of the recrystallized grains, it is necessary for Ni to be contained in a content of 0.03% by mass or more, and preferably 0.07% by mass or more. Particularly, with regard to the stress relaxation characteristics, an effect thereof becomes significant when 0.35% by mass of Ni is contained, and the effect becomes further significant when 0.45% by mass or more of Ni is contained. On the other hand, Ni deteriorates conductivity, and thus the content of Ni is set to 0.85% or less, and preferably 0.80% by mass or less. In addition, with regard to a relation with Sn, it is preferable that the content of Ni be ⅗ or more times the content of Sn, that is, it is preferable that Ni be contained 0.6 or more times the content of Sn, and more preferably 0.7 or more times the content of Sn so to satisfy a relational expression of a composition to be described later, and particularly, to improve stress relaxation characteristics and Young's modulus. The reason for this is as follows. With regard to an atomic concentration, when the content of Ni is equal to or greater than the content of Sn, the stress relaxation characteristics are improved. On the other hand, from a relationship between strength and conductivity, it is preferable that the content of Ni be set to 1.8 or less times or 1.7 or less times the content of Sn. In summary, to provide excellent stress relaxation characteristics, high strength, and conductivity, [Ni]/[Sn] is set to 0.6 or more, and preferably 0.7 or more, and [Ni]/[Sn] is set to 1.8 or less, and preferably 1.7 or less.

On the other hand, in a case where a high value is set on strength and conductivity, the content of Ni may be 0.2% by mass or less, and preferably 0.10% by mass or less. In this case, the balance between conductivity, strength, and ductility (bending workability) becomes satisfactory.

Similarly to Sn, with regard to the balance of strength, conductivity, stress relaxation characteristics, and the like, when a composition of Sn is slightly changed depending on characteristics on which a high value is set, Ni becomes a very suitable material. In addition, a mixing ratio of P is important for Ni. Particularly, when Co is not contained, [Ni]/[P] is preferably 1.0 or more to exhibit an operation of suppressing growth of crystal grains. To improve stress relaxation characteristics, [Ni]/[P] is preferably 8 or more, and when [Ni]/[P] is 12 or more, the stress relaxation characteristics become significant. From a relationship between conductivity and stress relaxation characteristics, the upper limit of [Ni]/[P] may be 40 or less, and preferably 35 or less.

However, to obtain the balance between strength and elongation, high strength, high spring characteristics, high conductivity, and satisfactory stress relaxation characteristics, it is necessary to consider not only mixing amounts of Zn, Sn, P, Co, and Ni, but also mutual relationships of respective elements. When an additive amount increases, stacking fault energy may be decreased due to divalent Zn and tetravalent Sn being contained. However, it is necessary to consider refinement of crystal grains by a synergistic effect due to P, Co, and Ni being contained, balance between strength and elongation, a difference in strength and elongation between in a direction making an angle of 0° with a rolling direction and in a direction making an angle of 90° with the rolling direction, conductivity, stress relaxation characteristics, stress corrosion cracking resistance, and the like. From the research of the present inventors, it has been proved that it is necessary for respective elements to satisfy a relationship of $11 \leq [Zn]+7[Sn]+15[P]+12[Co]+4.5[Ni] \leq 17$ within ranges of contents of the alloy of the invention. When this relationship is satisfied, a high-conductivity material, which has high strength and high elongation, and which is highly balanced in these characteristics, may be completed. (composition index $f1=[Zn]+7[Sn]+15[P]+12[Co]+4.5[Ni]$)

That is, in a final rolled material, it is necessary to satisfy $11 \leq f1 \leq 17$ so as to provide high conductivity as high as 32% IACS or more, satisfactory tensile strength of 500 N/mm$^2$ or more, high heat resistance, high stress relaxation characteristics, a small grain size, less directionality in strength, and satisfactory elongation. In $11 \leq f1 \leq 17$, the lower limit has a relationship with particularly, refinement of crystal grains, strength, stress relaxation characteristics, and heat resistance, and the lower limit is preferably 11.5 or more, and more preferably 12 or more. In addition, the upper limit has a relationship with particularly, conductivity, bending workability, stress relaxation characteristics, and stress corrosion cracking resistance, the upper limit is preferably 16 or less, and more preferably 15.5 or less. When Zn, Sn, Ni, P, and Co, which are primary elements, are managed within a relatively narrow range, a rolled material which is more balanced in conductivity, strength, and elongation may be obtained. In addition, in a member that is an object of the invention, it is not particularly necessary for the upper limit of conductivity to exceed 44% IACS or 42% IACS, and it is advantageous when strength is relatively high, and stress relaxation characteristics are more excellent. Spot welding may be performed depending on a use, and thus when conductivity is too high, a problem may occur in some cases. Accordingly, the conductivity is set to 44% IACS or less, and preferably 42% IACS or less.

However, with regard to ultra-refinement of crystal grains, in an alloy within the composition range of the alloy of the invention, recrystallized grains may be made fine up to 1.5 μm. However, when the crystal grains of the alloy are made ultrafine up to 1.5 μm, a percentage of grain boundaries, which are formed in a width to a degree of approximately several atoms, increases, and elongation, bending workability, and stress relaxation characteristics deteriorate. Accordingly, it is necessary for an average grain size to be 2.0 μm or more so as to provide high strength, high elongation, and satisfactory stress relaxation characteristics, preferably 2.5 μm or more, and more preferably 3.0 μm or more. On the other hand, as the crystal grains are enlarged, satisfactory elongation and bending workability are exhibited, but desired tensile strength and proof stress may not be obtained. At least, it is necessary for the average grain size to be as small as 8.0 μm or less. More preferably, the average grain size is 7.5 μm or less. In a case where a high value is set on strength, the average grain size is 6.0 μm or less, and preferably 5.0 μm or less. On the other hand, in a case in which stress relaxation characteristics are necessary, when the crystal grains are fine, the stress relaxation characteristics become poor. Accordingly, in a case where stress relaxation characteristics are necessary, the average grain size is preferably 3.0 μm or more, and more preferably 3.5 μm or more. In this manner, when the grain size is set within a relatively narrow range, very excellent balance between elongation, strength, conductivity, and stress relaxation characteristics may be obtained.

However, in a case where a rolled material that was cold-rolled at a cold rolling rate, for example, of 55% or more is subjected to annealing, although there is also a relationship with time, when exceeding an arbitrary threshold temperature, recrystallization nuclei are generated mainly at a grain boundary in which work strain is accumulated. Although it also depends on an alloy composition, in a case of the alloy of the invention, the grain size of recrystallized grains which may be obtained after nucleation is 1 μm or 2 μm, or smaller than this size. However, even when heat is applied to the rolled material, a worked structure is not entirely converted into recrystallized grains at one time. So as to allow the entirety of the worked structure, or for example, 97% or more thereof to be converted into recrystallized grains, a temperature that is further higher than a temperature at which nucleation of recrystallization is initiated, or a time that is further longer than a time for which nucleation of recrystallization is initiated is necessary. During the annealing, in recrystallized grains which are obtained for the first time, grain growth occurs, and thus a grain size thereof increases with the passage of time. To maintain a small recrystallized grain size, it is necessary to suppress growth of the recrystallized grains. To accomplish this object, P, Co, and Ni are made to be contained. Means such as a pin that suppresses the growth of the recrystallized grains is necessary so as to suppress growth of the recrystallized grains. In the alloy of the invention, a compound generated with P, Co, and Ni corresponds to the means such as the pin. The compound is optimal to serve as the pin. In order for the compound to serve as the pin, properties of the compound itself and a grain size of the compound are important. That is, from results of research, the present inventors have found that in a composition range of the invention, basically, the compound generated with P, Co, and Ni is less likely to hinder elongation. Particularly, when a particle size of the compound is 4.0 nm to 25.0 nm, the compound is less likely to hinder the elongation, and effectively suppresses the grain growth. Furthermore, when P and Co are added together, regarding the properties of the compound, [Co]/[P] is 0.2 or more, and preferably 0.3 or more. On the other hand, the present inventors have found that the upper limit of [Co]/[P] is 2.5 or less, and preferably 2 or less. On the other hand, in a case where P and Ni are contained, and Co is not contained, [Ni]/[P] is preferably 1 or more. In addition, it has been proved that when [Ni]/[P] exceeds 8, stress relaxation characteristics become satisfactory regardless of whether or not Co is contained, and when [Ni]/[P] exceeds 12, the effect further occurs, and becomes significant. In addition, in the case where P and Co are added together, an average particle size of precipitates that are formed is 4.0 nm to 15.0 nm, and thus the precipitates are slightly fine. In a case where P, Co, and Ni are added together, an average particle size of precipitates is 4.0 nm to 20.0 nm, and the larger the content of Ni is, the larger the particle size of precipitates becomes. In addition, in the case where P and Ni are added together, the particle size of precipitates is as large as 5.0 nm to 25.0 nm. In a case where P and Ni are added together, an effect of suppressing growth of crystal grains decreases, but an effect on elongation further decreases. In addition, in the case where P and Ni are added together, the chemical combination state of precipitates is mainly considered as $Ni_3P$ or $Ni_2P$. In the case where P and Co are added together, the chemical combination state of precipitates is mainly considered as $Co_2P$. In the case where P, Ni, and Co are added together, the chemical combination state of precipitates is mainly considered as $Ni_xCo_yP$ (x and y vary depending on the contents of Ni and Co). In addition, precipitates that may be obtained in the invention operate positively on stress relaxation characteristics, and as a kind of compound, a compound of Ni and P is preferable. In addition, in a case of a compound of Co and P in which a particle size of precipitates is small, when Co is contained in a content exceeding 0.08% by mass, an amount of precipitates increases too much, and thus the operation of suppressing growth of recrystallized grains becomes excessive. Therefore, the grain size of the recrystallized grains becomes small, and thus there is an adverse effect on stress relaxation characteristics and bending workability.

The properties of precipitates are important, and combinations of P—Co, P—Ni, and P—Co—Ni are optimal. However, for example, in addition to P and Fe, Mn, Mg, Cr, or the like forms a compound with P, and when a certain amount or more of the compound is contained, there is a concern that elongation may be hindered.

In addition, Fe may be utilized like Co and Ni, and particularly, like Co. That is, when 0.004% by mass of Fe is contained, due to formation of a compound of Fe—P, Fe—Ni—P, or Fe—Co—P, the effect of suppressing growth of crystal grains is exhibited similarly to the case of Co being contained, and thus strength and stress relaxation characteristics are improved. However, a particle size of the compound, which is formed, of Fe—P is smaller than that of the compound of Co—P. It is possible to satisfy a condition in which an average particle size of the precipitates is 4.0 nm to 25.0 nm, or a percentage of the number of precipitates having a particle size of 4.0 nm to 25.0 nm makes up 70% or more of the precipitates. Furthermore, the number of precipitated particles is a problematical matter, and thus the upper limit of Fe is 0.04% by mass, and preferably 0.03% by mass. When Fe is contained in combinations of P—Co, P—Ni, and P—Co—Ni, types of compounds include P—Co—Fe, P—Ni—Fe, and P—Co—Ni—Fe. Here, in a case where Co is contained, similarly to Co being contained alone, it is necessary for the total content of Co and Fe to be 0.08% by mass or less. It is preferable that the total content of Co and Fe be 0.05% by mass or less, and more preferably 0.04% by mass or less. When the concentration of Fe is managed within a more preferable range, a material, in which strength and conductivity are particularly high and in which bending workability and stress relaxation characteristics are satisfactory, may be obtained.

Accordingly, Fe may be effectively utilized so as to solve the problem of the invention.

On the other hand, it is necessary to manage elements such as Cr in a concentration not causing an effect. For this condition, at least, it is necessary to set the respective elements to 0.03% by mass or less, and preferably 0.02% by mass or less, or it is necessary to set the total content of elements such as Cr that chemically combines with P to 0.04% by mass or less, and preferably 0.03% by mass or less. When Cr and the like are contained, the composition and structure of precipitates vary, and this has a great effect on, particularly, elongation and bending workability.

As an index indicating an alloy that is highly balanced in strength, elongation, and conductivity, high product of these may be evaluated. When conductivity is set as C (% IACS), tensile strength is set as Pw ($N/mm^2$), and elongation is set as L (%) on the assumption that conductivity is 32% IACS or more and 44% IACS or less, and preferably 42% IACS or less, the product of Pw, (100+L)/100, and $C^{1/2}$ of the material after the recrystallization heat treatment is 2700 to 3500. Balance between strength, elongation, and electric conductivity of the rolled material after recrystallization heat treatment, and the like have a great effect on a rolled material after finish cold rolling, a rolled material after Sn plating, and characteristics after final recovery heat treatment (low-temperature annealing). That is, when the product of Pw, (100+L)/100, and $C^{1/2}$ is less than 2700, with regard to the final rolled material, an alloy that is highly balanced in characteristics may not be obtained. Preferably, the product is 2750 or more (balance index $f2=Pw\times\{(100+L)/100\}\times C^{1/2}$).

In addition, in the rolled material after the finish cold rolling, or the rolled material that is subjected to a recovery heat treatment after the finish cold rolling, the balance index f2 is 3200 to 4000 on the following assumption. In a W bending test, cracking does not occur at least at R/t=1 (R represents the radius of curvature of a bended portion, and t represents the thickness of the rolled material), preferably, cracking does not occur at R/t=0.5, and more preferably, cracking does not occur at R/t=0. Tensile strength is 500 $N/mm^2$ or more. Conductivity is 32% IACS or more and 44% IACS or less, and preferably 42% IACS or less. In the rolled material after the recovery heat treatment, it is preferable that the balance index f2 be 3300 or more, and more preferably 3400 or more in order for the rolled material to have more excellent balance. In addition, in practical use, a high value is set on proof stress in relation to tensile strength in many cases. In this case, proof stress Pw' is used in place of tensile strength of Pw, and the product of the proof stress Pw', (100+L)/100, and $C^{1/2}$ is 3100 or more, preferably 3200 or more, and still more preferably 3300 to 3900. Here, the standard of the W bending test indicates that when performing a test using test specimens collected in directions that are parallel with and perpendicular to a rolling direction, respectively, cracking does not occur in both of the test specimens. In addition, the tensile strength and proof stress which are used in the balance index f2 employ a value of the test specimen collected in the direction parallel to the rolling direction. The reason for this employment is that the tensile strength and proof stress of the test specimen collected in the direction parallel with the rolling direction are lower than the tensile strength and proof stress of the test specimen collected in the direction perpendicular to the rolling direction. However, generally, with regard to bending working, bending workability of the test specimen collected in the direction perpendicular to the rolling direction is poorer than bending workability of the test specimen collected in the direction parallel to the rolling direction.

Furthermore, in the case of the alloy of the invention, a working rate of 30% to 55% is applied in the finish cold rolling process, and thus bending workability is not largely deteriorated, that is, at least at W bending, cracking does not occur at R/t of 1 or less W bending, and tensile strength and proof stress may be increased by strain hardening. In general, when observing a metallographic structure of the finish cold-rolled material, crystal grains elongate in a rolling direction, and the crystal grains are compressed in a thickness direction. Accordingly, there is a difference in tensile strength, proof stress, and bending workability between the test specimen collected in the rolling direction and the test specimen collected in the perpendicular direction. With regard to a specific metallographic structure, when observing a cross-section parallel with a rolled surface, crystal grains elongate, and when observing a cross-section that crosses the rolled surface, the crystal grains are compressed in a thickness direction. Accordingly, a rolled material collected in a direction perpendicular to the rolling direction has tensile strength and proof stress higher than that of a rolled material collected in a direction parallel with the rolling direction, and ratios thereof may reach 1.05 to 1.1. As the ratios increase to greater than 1, bending workability of the test specimen collected in a direction perpendicular to the rolling direction deteriorates. Conversely, with regard to the proof stress, the ratios may be less than 0.95 in rare cases. Various members such as a connector that is an object of the invention are frequently used in the rolling direction and the perpendicular direction in practical use and during processing from a rolled material into a product, that is, the members may be used in both of the directions which are parallel with and perpendicular to the rolling direction. Accordingly, in practical use, it is preferable that a difference in characteristics such as tensile strength, proof stress, and bending workability be not present between the rolling direction and the perpendicular direction from aspects of practical use and product processing. According to the invention, when a rolled material is produced by a production process to be described later in such a manner that interaction of Zn, Sn, P, Ni, and Co, that is, a relational expression of $11\leq f1\leq 17$ is satisfied, an average grain size is set to 2.0 μm to 8.0 μm, and the size of precipitates formed from P and Co, or P and Ni, and a ratio between these elements are controlled to a predetermined value, the difference in tensile strength and proof stress of the rolled material between being collected in a direction making an angle of 0° with the rolling direction, and a direction making an angle of 90° with the rolling disappears. In addition, fine crystal grains are preferable from the viewpoints of strength, and occurrence of a rough skin and wrinkles in a bended surface. However, when the crystal grains are too fine, a percentage of grain boundaries in the metallographic structure increases, and thus, on the contrary, bending workability deteriorates. Accordingly, the average grain size is preferably 7.5 μm or less. In a case where a high value is set on strength, the average grain size is preferably 6.0 μm or less, and more preferably 5.0 μm or less. The lower limit of the average grain size is preferably 2.5 μm or more. In a case of a high value being set on stress relaxation characteristics, the average grain size is preferably 3.0 μm or more, and more preferably 3.5 μm or more. Ratios of tensile strength or proof stress in a direction making an angle of 90° with the rolling direction to tensile strength or proof stress in a direction making an angle of 0° with the rolling direction are 0.95 to 1.05. Furthermore, when a relational expression of $11\leq f1\leq 17$ is satisfied, and an average grain size is set to a more preferable state, a value of 0.98 to 1.03 may be accomplished. With this value, directionality becomes further less. Even in the bending workability, as can be determined from the metallographic structure, when the bending test is performed after collecting a test specimen in a direction having an angle of 90° with the rolling direction, the bending workability becomes poor in comparison to a test specimen collected in a direction having an angle of 0° with the rolling direction. In the alloy of the invention, tensile strength and proof stress have no directionality, and bending workability in a direction having an angle of 0° with the rolling direction and bending workability in a direction having an angle of 90° with the rolling direction are substantially the same as each other, and thus the alloy of the invention has excellent bending workability.

A hot rolling initiation temperature is set to 800° C. or higher, and preferably 840° C. or higher in order for respective elements to enter a solid solution state. In addition, from the viewpoints of energy cost and hot ductility, the hot rolling initiation temperature is set to 940° C. or lower, and preferably 920° C. or lower. In addition, it is preferable that cooling in a temperature region from a temperature after final rolling or 650° C. to 350° C. be performed at a cooling rate of 1° C./second or more in order for P, Co, Ni, or Fe to enter a further solid solution state, and in order for precipitates of these elements not to be coarse precipitates that hinder elongation. When cooling is performed at a cooling rate of 1° C./second or lower, precipitates of solid solution P, Co, Ni, or Fe begin to precipitate, and thus the precipitates become coarse during a cooling process. When precipitates become coarse during a hot rolling step, it is difficult to make the coarse precipitates disappear by a subsequent heat treatment such as an annealing process. Accordingly, elongation of a final rolled product is hindered.

In addition, a cold working rate process before a recrystallization heat treatment process is 55% or more, and the recrystallization heat treatment process, in which the highest arrival temperature is 550° C. to 790° C., a retention time in a range from a temperature of "the highest arrival temperature—50° C." to the highest arrival temperature is 0.04 minutes to 2 minutes, and a heat treatment index It satisfies an expression of 460≤It≤580, is performed.

As a target of the recrystallization heat treatment process, to obtain uniform and fine recrystallized grains not having a mixed grain size, lowering of stacking fault energy alone is not sufficient, and thus it is necessary to accumulate strain by cold rolling, specifically, strain at grain boundaries so as to increase recrystallization nucleation sites. Accordingly, it is necessary for the cold working rate during cold rolling before the recrystallization heat treatment process to be 55% or more, more preferably 60% or more, and still more preferably 65% or more. On the other hand, when the cold working rate of cold rolling during the recrystallization heat treatment process is raised too much, a problem of strain or the like occurs, and thus the cold working rate is preferably 97% or less, and more preferably 93% or less. That is, it is effective to raise the cold working rate so as to increase recrystallization nucleation sites by a physical operation. When a high working rate is applied within a range in which a strain of a product is permissible, relatively fine recrystallized grains may be obtained.

In addition, so as to realize fine and uniform crystal grains that are finally obtained, it is necessary to define a relationship between a grain size after an annealing process that is a heat treatment immediately before the recrystallization heat treatment process, and a working rate of second cold rolling before the recrystallization heat treatment process. That is, when the grain size after the recrystallization heat treatment process is set as D1, the grain size after the immediately preceding annealing process is set as D0, and a cold working rate of the second cold rolling between the recrystallization heat treatment process and the annealing process is set as RE (%), when RE is 55 to 97, it is preferable to satisfy $D0 \leq D1 \times 4 \times (RE/100)$. In addition, adaptation of this expression is possible when RE is within a range of 40 to 97. To make recrystallized grains after the recrystallization heat treatment process fine and uniform by realizing refinement of crystal grains, it is preferable that the grain size after the annealing process be equal to or less than the product of four times the grain size after the recrystallization heat treatment process, and RE/100. The higher the cold working rate is, the further the recrystallization nucleation site increases. Accordingly, even when the grain size after the annealing process is three or more times the grain size after the recrystallization heat treatment process, fine and uniform recrystallized grains may be obtained.

When the grain size after the annealing process is large, a mixed grain size is present after the recrystallization heat treatment process, and thus characteristics after the finish cold rolling process deteriorate. However, when the cold working rate between the annealing process and the recrystallization heat treatment process is raised, even when the grain size after the annealing process is slightly large, characteristics after the finish cold rolling process do not deteriorate.

In addition, in the recrystallization heat treatment process, a heat treatment for a short time is preferable. Specifically, the heat treatment is short-time annealing in which when the highest arrival temperature is 550° C. to 790° C., a retention time at a temperature range from "the highest arrival temperature—50° C." to the highest arrival temperature is 0.04 minutes to 2 minutes. More preferably, when the highest arrival temperature is 580° C. to 780° C., a retention time at a temperature range from "the highest arrival temperature—50° C." to the highest arrival temperature is 0.05 minutes to 1.5 minutes. In addition, it is necessary for the heat treatment index It to satisfy a relationship of 460≤It≤580. In the relational expression of 460≤It≤580, the lower limit is preferably 470 or more, and more preferably 480 or more. The upper limit is preferably 570 or less, and more preferably 560 or less.

With regard to precipitates which contain P and Co, or P and Ni that suppress growth of recrystallized grains, or which contain Fe as necessary, circular or elliptical precipitates are present at the stage of the recrystallization heat treatment process, and an average particle size of the precipitates may be 4.0 nm to 25.0 nm, or a percentage of the number of precipitated particles having a particle size of 4.0 nm to 25.0 nm may make up 70% or more of the precipitated particles. Preferably, the average particle size is 5.0 nm to 20.0 nm, or the percentage of the number of precipitated particles having a particle size of 4.0 nm to 25.0 nm may make up 80% or more of the precipitated particles. When the average particle size of the precipitates decreases, precipitation strengthening due to the precipitates, and an effect of suppressing growth of crystal grains are excessive, and thus the size of recrystallized grains decreases, whereby the strength of the rolled material increases. However, the bending workability becomes poor. In addition, when the particle size of the precipitates exceeds 50 nm, and reaches, for example, 100 nm, the effect of suppressing the growth of crystal grains substantially disappears, and thus the bending workability becomes poor. In addition, the circular or elliptical precipitates include not only a perfect circular or elliptical shape but also a shape approximate to the circular or elliptical shape as an object.

With regard to the conditions of the recrystallization heat treatment process, when the highest arrival temperature, the retention time, or the heat treatment index It is less than the lower limit of the above-described range, a non-recrystallized portion remains. In addition, it enters an ultrafine crystal grain state in which the average grain size is less than 2.0 μm. In addition, when the annealing is performed in a state in which the highest arrival temperature, the retention time, or the heat treatment index It is greater than the upper limit of the above-described ranges of the conditions of the recrystallization heat treatment process, excessive re-solid solution of precipitates occurs, and thus a predetermined effect of suppressing growth of crystal grains does not occur. Therefore, a fine metallographic structure in which the average grain size is 8 μm or less may not be obtained. In addition, conductivity becomes poor due to excessive solid solution.

The recrystallization heat treatment conditions are conditions for obtaining a target recrystallized grain size so as to prevent the excessive re-solid solution or coarsening of the precipitates, and when an appropriate heat treatment within the expression is performed, the effect of suppressing growth of recrystallized grains is obtained, and re-solid solution of an appropriate amount of P, Co, and Ni occurs, whereby elongation of a rolled material is improved. That is, with regard to precipitates of P, Co, and Ni, when a temperature of a rolled material begins to exceed 500° C., re-solid solution of the precipitates begins to start, and precipitates having a particle size smaller than 4 nm, which have an adverse effect on the bending workability, mainly disappear. As the heat treatment temperature is raised, and time is lengthened, a percentage of re-solid solution increases. The precipitates are mainly used for the effect of suppressing growth of recrystallized grains, and thus a lot of fine precipitates having a particle size of 4 nm or less, or a lot of coarse precipitates having a particle size of 25 nm or more remain, and the bending workability or elongation of the rolled material is hindered. In addition, during cooling in the recrystallization heat treatment process, in the temperature region from "the highest arrival temperature −50° C." to 350° C., the cooling is preferably performed under a condition of 1° C./second or more. When the cooling rate is slow, coarse precipitates appear, and thus elongation of the rolled material is hindered.

Furthermore, after finish cold rolling, as a heat treatment in which when the highest arrival temperature is 160° C. to 650° C., a retention time in a temperature region from "the highest arrival temperature—50° C." to the highest arrival temperature is 0.02 minutes to 200 minutes, a recovery heat treatment process in which the heat treatment index It satisfies a relationship $100 \leq It \leq 360$ may be performed.

This recovery heat treatment process is a heat treatment for improving a stress relaxation rate, a spring deflection limit, bending workability, and elongation of the rolled material by a low-temperature or short-time recovery heat treatment without being accompanied with recrystallization, and for recovering conductivity decreased due to cold rolling. In addition, with regard to the heat treatment index It, the lower limit is preferably 130 or more, and more preferably 180 or more. The upper limit is preferably 345 or less, and more preferably 330 or less. When the recovery heat treatment process is performed, the stress relaxation rate becomes approximately ½ times the stress relaxation rate before the heat treatment, and stress relaxation characteristics are improved. In addition, the spring deflection limit is improved by 1.5 times to 2 times, and conductivity is improved by 0.5% IACS to 1% IACS. In addition, in a Sn plating process, the rolled material is heated to a low temperature of approximately 200° C. to 300° C. Even when this Sn plating process is performed after the recovery heat treatment, the Sn plating process has little effect on characteristics after the recovery heat treatment. On the other hand, a heating process of the Sn plating process substitutes for the recovery heat treatment process, and improves stress relaxation characteristics of the rolled material, spring strength, and bending workability.

As an embodiment of the invention, the production process, which includes the hot rolling process, the first cold rolling process, the annealing process, the second cold rolling process, the recrystallization heat treatment process, and the finish cold rolling process in this order, has been illustrated as an example. However, it is not necessarily to perform the processes until the recrystallization heat treatment process, as long as in the metallographic structure of the copper alloy material before the finish cold rolling process, the average grain size is 2.0 μm to 8.0 μm, the circular or elliptical precipitates are present, and the average particle size of the precipitates is 4.0 nm to 25.0 nm, or a percentage of the number of precipitates having a particle size of 4.0 nm to 25.0 nm makes up 70% or more of the precipitates. For example, the copper alloy material having the metallographic structure may be obtained by a process such as hot extrusion, forging, and a heat treatment.

EXAMPLES

Specimens were prepared using the first to third alloys of the invention, and a copper alloy having a composition for comparison while changing a production process.

Table 1 shows compositions of the first to third alloys of the invention which were prepared as specimens, and the copper alloy for comparison. Here, in a case where Co is 0.001% by mass or less, Ni is 0.01% by mass or less, and Fe is 0.005% by mass or less, a blank space is left.

TABLE 1

| | Alloy | Alloy composition (% by mass) | | | | | | | | | | | |
|---|---|---|---|---|---|---|---|---|---|---|---|---|---|
| | No. | Cu | Zn | Sn | P | Co | Ni | Fe | Others | f1 | [Co]/[P] | [Ni]/[P] | [Ni]/[Sn] |
| Second alloy of the invention | 1 | Rem. | 6.3 | 0.58 | 0.04 | | 0.58 | | | 13.57 | 0.0 | 14.50 | 1.00 |
| | 2 | Rem. | 6.7 | 0.6 | 0.04 | 0.03 | 0.39 | | | 13.62 | 0.8 | 9.75 | 0.65 |
| First alloy of the invention | 3 | Rem. | 7.9 | 0.63 | 0.04 | 0.03 | 0.06 | | | 13.54 | 0.8 | 1.50 | 0.10 |
| | 4 | Rem. | 8.3 | 0.61 | 0.03 | 0.04 | | | | 13.50 | 1.3 | 0.00 | 0.00 |
| Second alloy of the invention | 5 | Rem. | 6.6 | 0.52 | 0.04 | 0.02 | 0.77 | | | 14.55 | 0.5 | 19.25 | 1.48 |
| First alloy of the invention | 6 | Rem. | 7.0 | 0.63 | 0.03 | 0.03 | | | | 12.22 | 1.0 | 0.00 | 0.00 |
| Second alloy of the invention | 7 | Rem. | 9.4 | 0.46 | 0.03 | 0.03 | 0.52 | | | 15.77 | 1.0 | 17.33 | 1.13 |
| First alloy of the invention | 11 | Rem. | 7.5 | 0.79 | 0.04 | 0.03 | | | | 13.99 | 0.8 | 0.00 | 0.00 |
| | 12 | Rem. | 8.3 | 0.62 | 0.03 | | 0.09 | | | 13.50 | 0.0 | 3.00 | 0.15 |
| | 13 | Rem. | 10.4 | 0.52 | 0.04 | 0.04 | 0.07 | | | 15.44 | 1.0 | 1.75 | 0.13 |
| | 14 | Rem. | 6.1 | 0.84 | 0.04 | 0.03 | | | | 12.94 | 0.8 | 0.00 | 0.00 |
| Second alloy of the invention | 15 | Rem. | 7.6 | 0.51 | 0.05 | | 0.65 | | | 14.85 | 0.0 | 13.00 | 1.27 |
| Second alloy of the invention | 160 | Rem. | 5.5 | 0.62 | 0.05 | | 0.71 | | | 13.79 | 0.0 | 14.20 | 1.15 |
| | 161 | Rem. | 5.6 | 0.59 | 0.04 | 0.01 | 0.69 | | | 13.56 | 0.3 | 17.25 | 1.17 |
| | 162 | Rem. | 5.6 | 0.56 | 0.04 | 0.01 | 0.52 | | | 12.58 | 0.3 | 13.00 | 0.93 |
| | 163 | Rem. | 5.3 | 0.57 | 0.03 | 0.01 | 0.39 | | | 11.62 | 0.3 | 13.00 | 0.68 |

TABLE 1-continued

| | Alloy No. | Alloy composition (% by mass) Cu | Zn | Sn | P | Co | Ni | Fe | Others | f1 | [Co]/[P] | [Ni]/[P] | [Ni]/[Sn] |
|---|---|---|---|---|---|---|---|---|---|---|---|---|---|
| First alloy of the invention | 164 | Rem. | 5.8 | 0.65 | 0.04 | 0.02 | 0.07 | | | 11.51 | 0.5 | 1.75 | 0.11 |
| | 165 | Rem. | 7.0 | 0.59 | 0.04 | 0.01 | 0.06 | | | 12.12 | 0.3 | 1.50 | 0.10 |
| | 166 | Rem. | 9.2 | 0.53 | 0.04 | 0.02 | 0.54 | | | 16.18 | 0.5 | 13.50 | 1.02 |
| Second alloy of the invention | 167 | Rem. | 6.4 | 0.8 | 0.04 | 0.01 | 0.45 | | | 14.75 | 0.3 | 11.25 | 0.56 |
| | 168 | Rem. | 7.0 | 0.42 | 0.04 | 0.01 | 0.77 | | | 14.13 | 0.3 | 19.25 | 1.83 |
| | 169 | Rem. | 6.6 | 0.62 | 0.04 | 0.01 | 0.54 | | | 14.09 | 0.3 | 13.50 | 0.87 |
| Third alloy of the invention | 170 | Rem. | 8.2 | 0.63 | 0.03 | | 0.1 | 0.03 | | 13.51 | 0.0 | 3.33 | 0.16 |
| | 171 | Rem. | 7.5 | 0.72 | 0.04 | 0.02 | | 0.02 | | 13.38 | 0.5 | 0.00 | 0.00 |
| | 172 | Rem. | 6.4 | 0.51 | 0.05 | 0.02 | 0.53 | 0.008 | | 13.35 | 0.4 | 10.60 | 1.04 |
| Comparative Example | 21 | Rem. | 8.6 | 0.6 | 0.03 | 0.003 | 0.02 | | | 13.38 | 0.1 | 0.67 | 0.03 |
| | 22 | Rem. | 6.9 | 0.61 | 0.003 | 0.04 | 0.38 | | | 13.41 | 13.3 | 126.67 | 0.62 |
| | 23 | Rem. | 7.8 | 0.69 | 0.04 | 0.14 | | | | 14.91 | 3.5 | 0.00 | 0.00 |
| | 24 | Rem. | 6.9 | 0.66 | 0.11 | 0.07 | 0.55 | | | 16.49 | 0.6 | 5.00 | 0.83 |
| | 26 | Rem. | 4.0 | 0.59 | 0.04 | 0.03 | 0.53 | | | 11.48 | 0.8 | 13.25 | 0.90 |
| | 27 | Rem. | 12.7 | 0.41 | 0.03 | 0.04 | 0.04 | | | 16.68 | 1.3 | 1.33 | 0.10 |
| | 28 | Rem. | 7.2 | 0.34 | 0.03 | 0.03 | 0.54 | | | 12.82 | 1.0 | 18.00 | 1.59 |
| | 29 | Rem. | 6.1 | 0.51 | 0.03 | 0.03 | | | | 10.48 | 1.0 | 0.00 | 0.00 |
| | 30 | Rem. | 9.9 | 0.88 | 0.05 | 0.05 | 0.09 | | | 17.82 | 1.0 | 1.80 | 0.10 |
| | 31 | Rem. | 5.8 | 0.41 | 0.03 | | 0.3 | | | 10.47 | 0.0 | 10.00 | 0.73 |
| | 32 | Rem. | 11.6 | 0.43 | 0.04 | 0.03 | 0.48 | | | 17.73 | 0.8 | 12.00 | 1.12 |
| | 33 | Rem. | 7.5 | 0.8 | 0.04 | 0.06 | | 0.03 | | 14.42 | 1.5 | 0.00 | 0.00 |
| | 34 | Rem. | 5.0 | 0.41 | 0.03 | | 0.9 | | | 12.37 | 0.0 | 30.00 | 2.20 |
| | 35 | Rem. | 5.1 | 0.43 | 0.03 | | 0.46 | | | 10.63 | 0.0 | 15.33 | 1.07 |
| | 36 | Rem. | 5.5 | 0.41 | 0.03 | 0.02 | 0.36 | | | 10.68 | 0.7 | 12.00 | 0.88 |
| | 37 | Rem. | 3.9 | 0.5 | 0.04 | 0.02 | 0.7 | | | 11.39 | 0.5 | 17.50 | 1.40 |
| | 38 | Rem. | 7.6 | 0.78 | 0.04 | 0.02 | 0.08 | | Cr: 0.05 | 14.26 | 0.5 | 2.00 | 0.10 |

f1 = [Zn] + 7[Sn] + 15[P] + 12[Co] + 4.5[Ni]

In alloy No. 21, the content of Co and the content of Ni are less than the composition range of the alloys of the invention.

In alloy No. 22, the content of P is less than the composition range of the alloys of the invention.

In alloy No. 23, the content of Co is greater than the composition range of the alloys of the invention.

In alloy No. 24, the content of P is greater than the composition range of the alloys of the invention.

In alloy Nos. 26 and 37, the content of Zn is less than the composition range of the alloys of the invention.

In alloy No. 27, the content of Zn is greater than the composition range of the alloys of the invention.

In alloy No. 28, the content of Sn is less than the composition range of the alloys of the invention.

In alloy Nos. 29, 31, 35, and 36, the composition index f1 is less than the range of the alloys of the invention.

In alloy Nos. 30 and 32, the composition index f1 is greater than the range of the alloys of the invention.

In alloy No. 34, the content of Ni is greater than the composition range of the alloys of the invention.

Alloy No. 38 contains Cr.

The production process of specimens was carried out by three kinds of A, B, and C, and production conditions were changed in each production process. The production process A was carried out by a practical mass production facility, and the production processes B and C were carried out by a test facility. Table 2 shows production conditions of each production process.

TABLE 2

| Process No. | | Hot rolling process Initiation temperature, sheet thickness | Cooling process Cooling rate | Milling process Sheet thickness | First cold rolling process Sheet thickness | Red *1 | Annealing process Heat treatment condition | Second cold rolling process Sheet thickness | Red | Recrystallization on heat treatment process Heat treatment condition | It | Finish cold rolling process Sheet thickness | Red | Recovery heat treatment process Heat treatment condition | It |
|---|---|---|---|---|---|---|---|---|---|---|---|---|---|---|---|
| A1 | Example | 860° C., 13 mm | 3° C./second | 12 mm | 1.6 mm | 87% | 470° C. × 4 Hr | 0.48 mm | 70% | 690° C. × 0.09 min | 529 | 0.3 mm | 37.5% | 540° C. × 0.04 min | 301 |
| A11 | Example | 860° C., 13 mm | 3° C./second | 12 mm | 1.6 mm | 87% | 470° C. × 4 Hr | 0.52 mm | 68% | 690° C. × 0.09 min | 528 | 0.3 mm | 42.3% | 540° C. × 0.04 min | 302 |
| A2 | Example | 860° C., 13 mm | 3° C./second | 12 mm | 1.6 mm | 87% | 470° C. × 4 Hr | 0.48 mm | 70% | 660° C. × 0.08 min | 491 | 0.3 mm | 37.5% | 540° C. × 0.04 min | 301 |
| A3 | Example | 860° C., 13 mm | 3° C./second | 12 mm | 1.6 mm | 87% | 470° C. × 4 Hr | 0.48 mm | 70% | 720° C. × 0.1 min | 566 | 0.3 mm | 37.5% | 540° C. × 0.04 min | 301 |
| A31 | Example | 860° C., 13 mm | 3° C./second | 12 mm | 1.6 mm | 87% | 470° C. × 4 Hr | 0.52 mm | 68% | 690° C. × 0.09 min | 565 | 0.3 mm | 42.3% | 540° C. × 0.04 min | 302 |
| A4 | Comparative Example | 860° C., 13 mm | 3° C./second | 12 mm | 1.6 mm | 87% | 470° C. × 4 Hr | 0.48 mm | 70% | 630° C. × 0.07 min | 451 | 0.3 mm | 37.5% | 540° C. × 0.04 min | 301 |
| A41 | Comparative Example | 860° C., 13 mm | 3° C./second | 12 mm | 1.6 mm | 87% | 470° C. × 4 Hr | 0.46 mm | 71% | 630° C. × 0.07 min | 452 | 0.3 mm | 34.8% | 540° C. × 0.04 min | 300 |

TABLE 2-continued

| Process No. | | Hot rolling process Initiation temperature, sheet thickness | Cooling process Cooling rate | Milling process Sheet thickness | First cold rolling process Sheet thickness | First cold rolling process Red *1 | Annealing process Heat treatment condition | Second cold rolling process Sheet thickness | Second cold rolling process Red | Recrystallization on heat treatment process Heat treatment condition | Recrystallization on heat treatment process It | Finish cold rolling process Sheet thickness | Finish cold rolling process Red | Recovery heat treatment process Heat treatment condition | Recovery heat treatment process It |
|---|---|---|---|---|---|---|---|---|---|---|---|---|---|---|---|
| A5 | Comparative Example | 860° C., 13 mm | 3° C./second | 12 mm | 1.6 mm | 87% | 470° C. × 4 Hr | 0.48 mm | 70% | 780° C. × 0.07 min | 601 | 0.3 mm | 37.5% | 540° C. × 0.04 min | 301 |
| A6 | Example | 860° C., 13 mm | 3° C./second | 12 mm | 1.6 mm | 87% | 470° C. × 4 Hr | 0.48 mm | 70% | 690° C. × 0.09 min | 529 | 0.3 mm | 37.5% | | |
| B1 | Example | 860° C., 8 mm | 3° C./second | Pickling | 1.6 mm | 80% | 610° C. × 0.23 min | 0.48 mm | 70% | 690° C. × 0.09 min | 529 | 0.3 mm | 37.5% | 540° C. × 0.04 min | 301 |
| B21 | Comparative Example | 860° C., 8 mm | 0.3° C./second | Pickling | 1.6 mm | 80% | 610° C. × 0.23 min | 0.48 mm | 70% | 690° C. × 0.09 min | 529 | 0.3 mm | 37.5% | 540° C. × 0.04 min | 301 |
| B32 | Comparative Example | 860° C., 8 mm | 3° C./second | Pickling | 0.8 mm | 90% | 470° C. × 4 Hr | 0.48 mm | 40% | 690° C. × 0.09 min | 518 | 0.3 mm | 37.5% | 540° C. × 0.04 min | 301 |
| B42 | Comparative Example | 860° C., 8 mm | 3° C./second | Pickling | 1.6 mm | 80% | 580° C. × 4 Hr | 0.48 mm | 70% | 690° C. × 0.09 min | 529 | 0.3 mm | 37.5% | 540° C. × 0.04 min | 301 |
| C1 | Example | 860° C., 8 mm | 3° C./second | Pickling | 1.6 mm | 80% | 610° C. × 0.23 min | 0.48 mm | 70% | 690° C. × 0.09 min | 529 | 0.3 mm | 37.5% | 540° C. × 0.04 min | 301 |
| C3 | Example | 860° C., 8 mm | 3° C./second | Pickling | 1.6 mm | 80% | 610° C. × 0.23 min | 0.52 mm | 68% | 690° C. × 0.09 min | 529 | 0.3 mm | 42.3% | 540° C. × 0.04 min | 302 |

*1: Red of the first cold rolling process was calculated by assuming that a decrease in sheet thickness due to pickling does not occur.

In processes A4, A41, and A5, the heat treatment index It deviates from a set condition range of the invention.

In process B21, a cooling rate after hot rolling deviates from the set condition range of the invention.

In process B32, Red of a second cold rolling process deviates from the set condition range of the invention.

In process B42, the set condition of the invention, that is, $D0 \leq D1 \times 4 \times (RE/100)$ is not satisfied.

In the production process A (A1, A11, A2, A3, A31, A4, A41, A5, and A6), a raw material was melted using an intermediate frequency melting furnace having an inner volume of 10 tons, and ingots having a cross-section of a thickness of 190 mm and a width of 630 mm were produced by semi-continuous casting. The ingots were cut to have a length of 1.5 m, respectively, and the cut ingots were subjected to a hot rolling process (sheet thickness: 13 mm), a cooling process, a milling process (sheet thickness: 12 mm), a first cold rolling process (sheet thickness: 1.6 mm), an annealing process (470° C., retention for 4 hours), a second cold rolling process (sheet thickness: 0.48 mm and cold working rate: 70%, but in A41, sheet thickness: 0.46 mm and cold working rate: 71%, and in A11 and A31, sheet thickness: 0.52 mm and cold working rate: 68%), a recrystallization heat treatment process, a finish cold rolling process (sheet thickness: 0.3 mm and cold working rate: 37.5%, but in A41, cold working rate: 34.8%, and in A11 and A31, cold working rate: 42.3%), and a recovery heat treatment process.

A hot rolling initiation temperature at the hot rolling process was set to 860° C., hot rolling was performed until reaching a sheet thickness of 13 mm, and in the cooling process, shower water cooling was performed. In this specification, the hot rolling initiation temperature and an ingot heating temperature were the same as each other. An average cooling rate in the cooling process was set as an average cooling rate in a temperature region from a temperature of a rolled material after final hot rolling or 650° C. to 350° C., and the average cooling rate was measured at a rear end of the rolled sheet. The measured average cooling rate was 3° C./second.

The shower water cooling in the cooling process was performed as follows. Shower equipment was provided at a position over conveying rollers which transmit the rolled material during hot rolling to be distant from rollers of hot rolling. When the final pass of the hot rolling is terminated, the rolled material is transmitted to the shower equipment by the conveying rollers, and is cooled down sequentially from the front end to the rear end while passing through the position at which showering is performed. In addition, the measurement of the cooling rate was performed as follows. A temperature measurement site of the rolled material was set to a rear end portion of the rolled material at the final pass of the hot rolling (exactly, a position corresponding to 90% of the length of the rolled material from a rolling front end in a longitudinal direction of the rolled material). A temperature was measured at a time immediately before the rolled material was transmitted to the shower equipment after the final pass was terminated, and at a time at which the shower water cooling was terminated. The cooling rate was calculated on the basis of measured temperatures and a measurement time interval. The temperature measurement was performed using a radiation thermometer. As the radiation thermometer, an infrared thermometer Fluke-574 (manufactured by Takachihoseiki Co., Ltd.) was used. Therefore, it enters an air cooling state until the rear end of the rolled material reaches the shower equipment, and shower water is applied to the rolled material, and thus a cooling rate at this time becomes slow. In addition, the smaller the final sheet thickness is, the longer a time taken to reach the shower equipment, and thus the cooling rate becomes slow.

The annealing process includes a heating step of heating the rolled material to a predetermined temperature, a retention step of retaining the rolled material at a predetermined temperature for a predetermined time after the heating step, and a cooling step of cooling down the rolled material to a predetermined temperature after the retention step. The highest arrival temperature was set to 470° C., and the retention time was set to 4 hours.

In the recrystallization heat treatment process, the highest arrival temperature Tmax (° C.) of the rolled material, and the retention time tm (min) in a temperature region from a temperature lower than the highest arrival temperature of the rolled material by 50° C. to the highest arrival temperature were changed to (690° C.-0.09 minutes), (660° C.-0.08 minutes), (720° C.-0.1 minutes), (630° C.-0.07 minutes), and (780° C.-0.07 minutes).

In addition, as described above, the cold working rate in the final cold rolling process was set to 37.5% (however, A41 was set to 34.8%, and A11 and A31 were set to 42.3%).

In the recovery heat treatment process, the highest arrival temperature Tmax (° C.) was set to 540 (° C.), and the retention time tm (min) in a temperature region from a temperature lower than the highest arrival temperature of the rolled material by 50° C. to the highest arrival temperature was set to 0.04 minutes. However, in the production process A6, the recovery heat treatment process was not carried out.

In addition, the production process B (B1, B21, B32, and B42) was carried out as follows.

Ingots of the production process A were cut into ingots for a laboratory test which had a thickness of 40 mm, a width of 120 mm, and a length of 190 mm, and then the cut ingots were subjected to a hot rolling process (sheet thickness: 8 mm), a cooling process (shower water cooling), a pickling process, a first cold rolling process, an annealing process, a second cold rolling process (sheet thickness: 0.48 mm), a recrystallization heat treatment process, a finish cold rolling process (sheet thickness: 0.3 mm, and a working rate: 37.5%), and a recovery heat treatment.

In the hot rolling process, each of the ingots was heated at 860° C., and the ingot was hot-rolled to a thickness of 8 mm. A cooling rate (cooling rate in a temperature range from a temperature of a rolled material after the hot rolling, or 650° C. to 350° C.) at the cooling process was mainly set to 3° C./second, and partially set to 0.3° C./second.

A surface of the rolled material was pickled after the cooling process, and the rolled material was cold-rolled to 1.6 mm, 1.2 mm, or 0.8 mm in the first cold rolling process, and conditions of the annealing process were changed to (610° C., retention for 0.23 minutes), (470° C., retention for 4 hours), (510° C., retention for 4 hours), (580° C., retention for 4 hours). Then, the rolled material was rolled to 0.48 mm in the second cold rolling process.

The recrystallization heat treatment process was carried out under conditions of Tmax of 690 (° C.) and a retention time tm of 0.09 minutes. In addition, in the finish cold rolling process, the rolled material was cold-rolled to 0.3 mm (cold working rate: 37.5%), and the recovery heat treatment process was carried out under conditions of Tmax of 540 (° C.) and a retention time tm of 0.04 minutes.

In the production process B, and the production process C to be described later, a process corresponding to a short-time heat treatment performed by a continuous annealing line or the like in the production process A was substituted with immersion of the rolled material in a salt bath, the highest arrival temperature was set to a temperature of a liquid of the salt bath, an immersion time was set to the retention time, and air cooling was performed after immersion. In addition, a mixed material of BaCl, KCl, and NaCl was used as salt (solution).

Furthermore, the process C (C1, C3) as a laboratory test was carried out as follows. Melting and casting were performed with an electric furnace in a laboratory to have predetermined components, whereby ingots for a laboratory test, which had a thickness of 40 mm, a width of 120 mm, and a length of 190 mm, were obtained. Then, production was carried out by the same processes as the above-described process B. That is, each of the ingots was heated to 860° C., the ingot was hot-rolled to a thickness of 8 mm, and after the hot rolling, the ingot was cooled at a cooling rate of 3° C./second in a temperature range from a temperature of the rolled material after the hot rolling, or 650° C. to 350° C. A surface of the rolled material was pickled after the cooling, and the rolled material was cold-rolled in the first cold rolling process to 1.6 mm. After the cold rolling, the annealing process was carried out under conditions of 610° C. and 0.23 minutes. In the second cold rolling process, C1 was cold-rolled to a sheet thickness of 0.48 mm, and C3 was cold-rolled to a sheet thickness of 0.52 mm. The recrystallization heat treatment process was carried out under conditions of Tmax of 690 (° C.) and a retention time tm of 0.09 minutes. In addition, in the finish cold rolling process, the rolled material was cold-rolled to a sheet thickness of 0.3 mm (cold working rate of C1: 37.5%, and cold working rate of C3: 42.3%), and the recovery heat treatment process was carried out under conditions of Tmax of 540 (° C.) and a retention time tm of 0.04 minutes.

As an evaluation of copper alloys produced by the above-described methods, tensile strength, proof stress, elongation, conductivity, bending workability, stress relaxation rate, stress corrosion cracking resistance, and a spring deflection limit were measured. In addition, a metallographic structure was observed to measure an average grain size. In addition, an average particle size of precipitates, and a percentage of the number of precipitates having a predetermined particle size or less in the precipitates of all sizes was measured.

Results of the respective tests are shown in Tables 3 to 12. Here, test results of each test No. are shown by two tables like Table 3 and 4. In addition, in the production process A6, the recovery heat treatment process was not carried out, and thus data after finish cold rolling process is described in a column of data after the recovery heat treatment process.

In addition, FIG. 1 shows a transmission electron microscope photograph of a copper alloy sheet of an alloy No. 2 (test No. T15). In FIG. 1, it can be see that the average particle size of precipitates is approximately 7 nm, and the distribution of the particle size is uniform.

TABLE 3

| | | | | After recrystallization heat treatment process | | | After recovery heat treatment process | | | | | | |
|---|---|---|---|---|---|---|---|---|---|---|---|---|---|
| | | | Average grain size D0 after | | Precipitated particles | | Characteristics of rolled material (0° direction) | | | | | Characteristics of rolled material (90° direction) | |
| Test No. | Alloy No. | Process No. | annealing process μm | Average grain size D1 μm | Average particle size nm | Percentage of particles of 4 to 25 nm % | Tensile strength N/mm² | Proof stress N/mm² | Elongation % | Conductivity % IACS | Balance index f2 | Tensile strength N/mm² | Proof stress N/mm² |
| T1 | 1 | A1 | 5 | 3.8 | 10 | 94 | 526 | 515 | 9 | 36.2 | 3450 | 532 | 518 |
| T2 | | A11 | | 3.8 | 10 | 94 | 551 | 539 | 6 | 36 | 3504 | 561 | 550 |
| T3 | | A2 | | 3.2 | 9.4 | 92 | 538 | 521 | 8 | 36.5 | 3510 | 544 | 525 |
| T4 | | A4 | | 2.4 | 4.5 | 75 | 551 | 537 | 4 | 36.7 | 3472 | 582 | 567 |
| T5 | | A3 | | 5 | 13 | 88 | 510 | 503 | 9 | 35.8 | 3326 | 522 | 513 |
| T6 | | A31 | | 5 | 13 | 88 | 534 | 526 | 7 | 35.7 | 3414 | 545 | 538 |
| T7 | | A5 | | 13 | 60 | 20 | 472 | 455 | 10 | 35.1 | 3076 | 496 | 482 |

TABLE 3-continued

| Test No. | Alloy No. | Process No. | Average grain size D0 after annealing process μm | After recrystallization heat treatment process: Average grain size D1 μm | Precipitated particles: Average particle size nm | Precipitated particles: Percentage of particles of 4 to 25 nm % | After recovery heat treatment process: Characteristics of rolled material (0° direction): Tensile strength N/mm$^2$ | Proof stress N/mm$^2$ | Elongation % | Conductivity % IACS | Balance index f2 | Characteristics of rolled material (90° direction): Tensile strength N/mm$^2$ | Proof stress N/mm$^2$ |
|---|---|---|---|---|---|---|---|---|---|---|---|---|---|
| T8 | | A6 | | 3.8 | 10 | 94 | 540 | 520 | 4 | 35 | 3322 | 553 | 528 |
| T9 | | B1 | 5 | 3.9 | 11 | 94 | 524 | 515 | 8 | 36.1 | 3400 | 530 | 516 |
| T10 | | B21 | | 8.5 | 27 | 65 | 489 | 473 | 7 | 36 | 3139 | 513 | 493 |
| T12 | | B32 | 5 | 4.5 | Mixed grain size | | 510 | 496 | | 36.2 | 3253 | 537 | 524 |
| T14 | | B42 | 19 | 4.7 | Mixed grain size | | 510 | 492 | 6 | 36.4 | 3262 | 539 | 520 |
| T15 | 2 | A1 | 4.5 | 3.4 | 7 | 91 | 535 | 527 | 9 | 36.9 | 3542 | 541 | 525 |
| T16 | | A11 | | 3.4 | 7 | 91 | 561 | 550 | 6 | 36.8 | 3607 | 572 | 558 |
| T17 | | A2 | | 2.7 | 6.3 | 87 | 548 | 538 | 8 | 37.4 | 3619 | 562 | 544 |
| T18 | | A4 | | 1.8 | 3.5 | 40 | 573 | 552 | 6 | 38 | 3744 | 608 | 588 |
| T19 | | A3 | | 4.4 | 11 | 92 | 521 | 507 | 10 | 36.4 | 3458 | 538 | 522 |
| T20 | | A31 | | 4.4 | 11 | 92 | 545 | 535 | 7 | 36.3 | 3513 | 557 | 545 |
| T21 | | A5 | | 10.5 | 45 | 25 | 470 | 456 | 11 | 35.6 | 3113 | 499 | 482 |
| T22 | | A6 | | 3.4 | 7 | 91 | 547 | 532 | 4 | 36 | 3413 | 565 | 546 |

TABLE 4

| Test No. | Alloy No. | Process No. | After recovery heat treatment process: Ratio of 90° tensile strength to 0° tensile strength | Ratio of 90° proof stress to 0° proof stress | Bending workability: 90° direction Bad Way | Bending workability: 0° direction Good Way | Stress relaxation rate | % | Stress corrosion cracking resistance: Stress corrosion 1 | Stress corrosion 2 | Spring deflection limit: 0° direction N/mm$^2$ | Spring deflection limit: 90° direction N/mm$^2$ |
|---|---|---|---|---|---|---|---|---|---|---|---|---|
| T1 | 1 | A1 | 1.011 | 1.006 | S | S | S | 15 | A | A | 487 | 507 |
| T2 | | A11 | 1.018 | 1.020 | S | S | S | 16 | A | A | 502 | 516 |
| T3 | | A2 | 1.011 | 1.008 | S | S | A | | A | A | 480 | 505 |
| T4 | | A4 | 1.056 | 1.056 | B | S | B | | A | A | 523 | 542 |
| T5 | | A3 | 1.024 | 1.020 | S | S | S | 14 | A | A | | |
| T6 | | A31 | 1.021 | 1.023 | S | S | S | 14 | A | A | 515 | 526 |
| T7 | | A5 | 1.051 | 1.059 | A | S | S | | A | A | | |
| T8 | | A6 | 1.024 | 1.015 | S | S | B | | A | A | | |
| T9 | | B1 | 1.011 | 1.002 | S | S | S | 15 | A | A | | |
| T10 | | B21 | 1.049 | 1.042 | A | S | A | | A | A | | |
| T12 | | B32 | 1.053 | 1.056 | B | S | B | | A | A | | |
| T14 | | B42 | 1.057 | 1.057 | B | S | B | | A | A | | |
| T15 | 2 | A1 | 1.011 | 0.996 | S | S | A | 22 | A | A | 493 | 510 |
| T16 | | A11 | 1.020 | 1.015 | A | S | A | 23 | | | | |
| T17 | | A2 | 1.026 | 1.011 | S | S | B | | A | A | 506 | 524 |
| T18 | | A4 | 1.061 | 1.065 | C | B | B | | A | A | 533 | 554 |
| T19 | | A3 | 1.033 | 1.030 | S | S | A | 20 | A | A | | |
| T20 | | A31 | 1.022 | 1.019 | S | S | A | 20 | | | | |
| T21 | | A5 | 1.062 | 1.057 | B | S | A | | A | A | | |
| T22 | | A6 | 1.033 | 1.026 | A | S | B | | A | A | | |

TABLE 5

| Test No. | Alloy No. | Process No. | Average grain size D0 after annealing process μm | After recrystallization heat treatment process: Average grain size D1 μm | Precipitated particles: Average particle size nm | Precipitated particles: Percentage particles of 4 to 25 nm % | After recovery heat treatment process: Characteristics of rolled material (0° direction): Tensile strength N/mm² | Proof stress N/mm² | Elongation % | Conductivity % IACS | Balance index f2 | Characteristics of rolled material (90° direction): Tensile strength N/mm² | Proof stress N/mm² |
|---|---|---|---|---|---|---|---|---|---|---|---|---|---|
| T23 | 3 | A1 | 4.5 | 3.4 | 7.4 | 91 | 532 | 521 | 8 | 37.5 | 3518 | 540 | 525 |
| T24 | | A11 | | 3.4 | 7.4 | 91 | 560 | 545 | 5 | 37.4 | 3596 | 571 | 553 |
| T25 | | A2 | | 2.9 | 6.5 | 87 | 544 | 530 | 8 | 37.8 | 3612 | 556 | 540 |
| T26 | | A4 | | 1.9 | 3.7 | 50 | 564 | 550 | 4 | 38 | 3616 | 594 | 576 |
| T27 | | A3 | | 4.5 | 13 | 95 | 516 | 507 | 9 | 37 | 3421 | 530 | 517 |
| T28 | | A31 | | 4.5 | 13 | 95 | 541 | 530 | 7 | 37 | 3521 | 558 | 540 |
| T29 | | A5 | | 12.5 | 50 | 20 | 466 | 447 | 10 | 36.4 | 3093 | 495 | 472 |
| T30 | | A6 | | 3.4 | 7.4 | 91 | 546 | 523 | 4 | 36.6 | 3435 | 564 | 539 |
| T31 | | B1 | 4.5 | 3.5 | 7.5 | 92 | 530 | 520 | 8 | 37.5 | 3505 | 538 | 526 |
| T32 | | B21 | | 7 | 26 | 68 | 481 | 466 | 8 | 37.7 | 3190 | 505 | 488 |
| T34 | | B32 | 4.3 | 4.3 | Mixed grain size | | 522 | 505 | 6 | 37.6 | 3393 | 556 | 540 |
| T36 | | B42 | 17 | 5 | Mixed grain size | | 503 | 486 | 5 | 37.8 | 3247 | 532 | 511 |
| T37 | 4 | A1 | 4.2 | 3.3 | 6.5 | 86 | 542 | 530 | 8 | 37.2 | 3570 | 550 | 534 |
| T38 | | A2 | | 2.6 | 6 | 82 | 555 | 542 | 7 | 37.3 | 3627 | 570 | 554 |
| T39 | | A4 | | 1.8 | 3.7 | 35 | 580 | 560 | 5 | 37.4 | 3724 | 618 | 592 |
| T40 | | A41 | | 1.8 | 3.6 | 35 | 556 | 539 | 5 | 37.4 | 3570 | 587 | 564 |
| T41 | | A3 | | 4.5 | 14 | 84 | 522 | 511 | 9 | 37 | 3461 | 536 | 522 |
| T42 | | A5 | | 14 | 55 | 20 | 462 | 446 | 9 | 36.7 | 3051 | 492 | 472 |
| T43 | | A6 | | 3.3 | 6.5 | 86 | 559 | 533 | 5 | 36.3 | 3536 | 573 | 546 |
| T44 | | B1 | 4.4 | 3.5 | 6.8 | 87 | 539 | 526 | 8 | 37.3 | 3555 | 548 | 530 |

TABLE 6

| Test No. | Alloy No. | Process No. | After recovery heat treatment process: Ratio of 90° tensile strength to 0° tensile strength | Ratio of 90° proof stress to 0° proof stress | Bending workability: 90° direction Bad Way | Bending workability: 0° direction Good Way | Stress relaxation rate | % | Stress corrosion cracking resistance: Stress corrosion 1 | Stress corrosion 2 | Spring deflection limit: 0° direction N/mm² | Spring deflection limit: 90° direction N/mm² |
|---|---|---|---|---|---|---|---|---|---|---|---|---|
| T23 | 3 | A1 | 1.015 | 1.008 | S | S | B | 34 | A | A | 488 | 502 |
| T24 | | A11 | 1.020 | 1.015 | A | S | B | 35 | | | | |
| T25 | | A2 | 1.022 | 1.019 | A | S | B | | A | A | | |
| T26 | | A4 | 1.053 | 1.047 | B | A | C | | A | A | | |
| T27 | | A3 | 1.027 | 1.020 | S | S | A | 28 | A | A | | |
| T28 | | A31 | 1.031 | 1.019 | S | S | A | 28 | | | | |
| T29 | | A5 | 1.062 | 1.056 | A | S | B | | A | A | | |
| T30 | | A6 | 1.033 | 1.031 | A | S | C | | A | A | | |
| T31 | | B1 | 1.015 | 1.012 | S | S | B | 35 | A | A | 479 | 504 |
| T32 | | B21 | 1.050 | 1.047 | A | S | B | | A | A | | |
| T34 | | B32 | 1.065 | 1.069 | B | S | B | | A | A | | |
| T36 | | B42 | 1.058 | 1.051 | B | S | B | | A | A | | |
| T37 | 4 | A1 | 1.015 | 1.008 | S | S | B | 37 | A | A | 495 | 513 |
| T38 | | A2 | 1.027 | 1.022 | A | S | B | | A | A | | |
| T39 | | A4 | 1.066 | 1.057 | C | B | C | | A | A | | |
| T40 | | A41 | 1.056 | 1.046 | C | A | C | | A | A | | |
| T41 | | A3 | 1.027 | 1.022 | S | S | B | 35 | A | A | | |
| T42 | | A5 | 1.065 | 1.058 | B | S | B | | A | B | | |
| T43 | | A6 | 1.025 | 1.024 | S | S | C | | A | A | | |
| T44 | | B1 | 1.017 | 1.008 | S | S | B | 37 | A | A | 506 | 520 |

TABLE 7

| | | | After recrystallization heat treatment process | | | | After recovery heat treatment process | | | | | | |
|---|---|---|---|---|---|---|---|---|---|---|---|---|---|
| | | | | | Precipitated particles | | Characteristics of rolled material (0° direction) | | | | | Characteristics of rolled material (90° direction) | |
| Test No. | Alloy No. | Process No. | Average grain size D0 after annealing process μm | Average grain size D1 μm | Average particle size nm | Percentage of particles of 4 to 25 nm % | Tensile strength N/mm$^2$ | Proof stress N/mm$^2$ | Elongation % | Conductivity % IACS | Balance index f2 | Tensile strength N/mm$^2$ | Proof stress N/mm$^2$ |
| T45 | 4 | B21 | | 7 | 26 | 68 | 482 | 464 | 8 | 37.5 | 3188 | 507 | 488 |
| T47 | | B32 | 4.2 | 4.4 | Mixed grain size | | 531 | 515 | 6 | 37.2 | 3433 | 561 | 543 |
| T49 | | B42 | 19 | 5 | Mixed grain size | | 508 | 492 | 5 | 37.4 | 3262 | 539 | 519 |
| T50 | 5 | A1 | 5.2 | 3.9 | 9.5 | 95 | 522 | 509 | 9 | 35.7 | 3400 | 529 | 514 |
| T51 | | A11 | | 3.8 | 11 | 95 | 547 | 535 | 6 | 35.6 | 3460 | 557 | 544 |
| T52 | | A2 | | 3.4 | 7.5 | 92 | 538 | 525 | 8 | 36 | 3486 | 552 | 531 |
| T53 | | A3 | | 5.6 | 16 | 90 | 511 | 500 | 9 | 35 | 3295 | 522 | 509 |
| T54 | | A31 | | 5.4 | 16 | 90 | 538 | 526 | 7 | 35 | 3406 | 553 | 537 |
| T55 | | A5 | | 15 | 60 | 15 | 466 | 450 | 9 | 34 | 2962 | 492 | 473 |
| T56 | | A6 | | 4 | 11 | 95 | 540 | 518 | 5 | 34.2 | 3316 | 553 | 529 |
| T57 | | B1 | 5.4 | 3.9 | 11 | 94 | 529 | 517 | 9 | 35.5 | 3436 | 538 | 522 |
| T58 | | B21 | | 9 | 18 | 65 | 489 | 475 | 8 | 36.1 | 3173 | 514 | 497 |
| T60 | | B32 | 5.2 | 5.4 | Mixed grain size | | 515 | 497 | 7 | 36 | 3306 | 542 | 521 |
| T62 | | B42 | 22 | 6 | Mixed grain size | | 499 | 479 | 6 | 36.2 | 3182 | 528 | 506 |
| T63 | 6 | A1 | 4.5 | 3.8 | 6.4 | 85 | 524 | 511 | 9 | 40.5 | 3635 | 532 | 514 |
| T64 | | A11 | | 3.8 | 6.4 | 85 | 551 | 539 | 6 | 40 | 3694 | 563 | 546 |
| T65 | | A2 | | 3.4 | 5.8 | 78 | 539 | 527 | 8 | 40.4 | 3700 | 549 | 536 |
| T66 | | A5 | | 20 | 65 | 15 | 460 | 442 | 9 | 39.6 | 3155 | 487 | 467 |
| T67 | | A6 | | 3.8 | 6.4 | 85 | 541 | 513 | 4 | 39.4 | 3532 | 556 | 524 |

TABLE 8

| | | | After recovery heat treatment process | | | | | | | | |
|---|---|---|---|---|---|---|---|---|---|---|---|
| | | | | | Bending workability | | Stress | Stress corrosion cracking resistance | | Spring deflection limit | |
| Test No. | Alloy No. | Process No. | Ratio of 90° tensile strength to 0° tensile strength | Ratio of 90° proof stress to 0° proof stress | 90° direction Bad Way | 0° direction Good Way | relaxation rate % | Stress corrosion 1 | Stress corrosion 2 | 0° direction N/mm$^2$ | 90° direction N/mm$^2$ |
| T45 | 4 | B21 | 1.052 | 1.052 | B | S | C | A | A | | |
| T47 | | B32 | 1.056 | 1.054 | C | S | B | A | A | | |
| T49 | | B42 | 1.061 | 1.055 | B | S | C | A | B | | |
| T50 | 5 | A1 | 1.013 | 1.010 | S | S | S 12 | A | A | 492 | 500 |
| T51 | | A11 | 1.018 | 1.017 | S | S | S 12 | A | A | | |
| T52 | | A2 | 1.026 | 1.011 | S | S | S | A | A | 504 | 517 |
| T53 | | A3 | 1.022 | 1.018 | S | S | S 11 | A | A | | |
| T54 | | A31 | 1.028 | 1.021 | S | S | S 11 | | | | |
| T55 | | A5 | 1.056 | 1.051 | B | S | A | A | A | | |
| T56 | | A6 | 1.024 | 1.021 | A | S | B | A | A | | |
| T57 | | B1 | 1.017 | 1.010 | S | S | S 12 | A | A | 482 | 503 |
| T58 | | B21 | 1.051 | 1.046 | A | S | A | A | A | | |
| T60 | | B32 | 1.052 | 1.048 | B | S | A | A | A | | |
| T62 | | B42 | 1.058 | 1.056 | B | S | A | A | A | | |
| T63 | 6 | A1 | 1.015 | 1.006 | S | S | B 42 | A | A | 477 | 486 |
| T64 | | A11 | 1.022 | 1.013 | S | S | B 43 | | | | |
| T65 | | A2 | 1.019 | 1.017 | S | S | B | A | A | | |
| T66 | | A5 | 1.059 | 1.057 | B | S | B | A | A | | |
| T67 | | A6 | 1.028 | 1.021 | S | S | C | A | A | | |

TABLE 9

| Test No. | Alloy No. | Process No. | Average grain size D0 after annealing process μm | After recrystallization heat treatment process: Average grain size D1 μm | Precipitated particles: Average particle size nm | Precipitated particles: Percentage particles of 4 to 25 nm % | After recovery heat treatment process: Characteristics of rolled material (0° direction): Tensile strength N/mm² | Proof stress N/mm² | Elongation % | Conductivity % IACS | Balance index f2 | Characteristics of rolled material (90° direction): Tensile strength N/mm² | Proof stress N/mm² |
|---|---|---|---|---|---|---|---|---|---|---|---|---|---|
| T68 | 7 | A1 | 5 | 3.9 | 9 | 92 | 534 | 520 | 7 | 34 | 3332 | 548 | 530 |
| T69 | | A2 | | 3.4 | 8 | 87 | 546 | 531 | 6 | 34.2 | 3385 | 561 | 544 |
| T70 | | A4 | | 1.9 | 3.8 | 60 | 567 | 553 | 4 | 34.5 | 3464 | 599 | 584 |
| T71 | | A5 | | 11 | 50 | 20 | 486 | 470 | 8 | 33 | 3015 | 512 | 496 |
| T72 | | A6 | | 3.9 | 9 | 92 | 550 | 526 | 4 | 33.2 | 3296 | 569 | 544 |
| T73 | 11 | C1 | | 3 | 6.6 | 85 | 552 | 540 | 7 | 36.3 | 3559 | 567 | 550 |
| T74 | 12 | C1 | | 3.9 | 13 | 95 | 539 | 524 | 9 | 37 | 3574 | 550 | 532 |
| T75 | 13 | C1 | | 3.2 | 7.5 | 92 | 550 | 534 | 7 | 34.4 | 3452 | 570 | 548 |
| T76 | 14 | C1 | | 3.2 | 7.1 | 88 | 544 | 528 | 7 | 38.1 | 3593 | 557 | 537 |
| T77 | 15 | C1 | | 3.7 | 12 | 94 | 538 | 525 | 8 | 34.7 | 3423 | 550 | 531 |
| T78 | 160 | C1 | | 5.5 | 14 | 95 | 512 | 500 | 9 | 36 | 3348 | 516 | 505 |
| T80 | 161 | C1 | | 4.5 | 9 | 90 | 516 | 503 | 8 | 36.3 | 3358 | 526 | 509 |
| T81 | 162 | C1 | | 5 | 9 | 92 | 513 | 501 | 9 | 39.1 | 3496 | 523 | 508 |
| T83 | 163 | C1 | | 5.2 | 12 | 95 | 505 | 490 | 9 | 40.3 | 3494 | 511 | 495 |
| T84 | 164 | C1 | | 4.8 | 10 | 90 | 515 | 502 | 9 | 41.3 | 3608 | 528 | 510 |
| T85 | 165 | C1 | | 4.5 | 11 | 95 | 530 | 514 | 9 | 39.4 | 3626 | 542 | 522 |
| T87 | 166 | C1 | | 3.5 | 6 | 85 | 557 | 540 | 7 | 33.2 | 3434 | 575 | 555 |
| T88 | 167 | C1 | | 3.5 | 10 | 92 | 546 | 529 | 8 | 34.8 | 3479 | 558 | 536 |
| T89 | 168 | C1 | | 4.5 | 12 | 95 | 507 | 494 | 9 | 36.7 | 3348 | 519 | 504 |
| T90 | 169 | C1 | | 3.8 | 11 | 95 | 533 | 519 | 9 | 35.2 | 3447 | 542 | 524 |
| T92 | 170 | C1 | | 2.8 | 4.9 | 80 | 545 | 519 | 7 | 36.1 | 3504 | 563 | 536 |

TABLE 10

| Test No. | Alloy No. | Process No. | After recovery heat treatment process: Ratio of 90° tensile strength to 0° tensile strength | Ratio of 90° proof stress to 0° proof stress | Bending workability: 90° direction Bad Way | Bending workability: 0° direction Good Way | Stress relaxation rate | % | Stress corrosion cracking resistance: Stress corrosion 1 | Stress corrosion 2 | Spring deflection limit: 0° direction N/mm² | Spring deflection limit: 90° direction N/mm² |
|---|---|---|---|---|---|---|---|---|---|---|---|---|
| T68 | 7 | A1 | 1.026 | 1.019 | S | S | A | 19 | A | A | 500 | 512 |
| T69 | | A2 | 1.027 | 1.024 | A | S | A | | A | A | | |
| T70 | | A4 | 1.056 | 1.056 | C | B | B | | A | A | | |
| T71 | | A5 | 1.053 | 1.055 | B | S | A | | B | B | | |
| T72 | | A6 | 1.035 | 1.034 | B | S | B | | A | B | | |
| T73 | 11 | C1 | 1.027 | 1.019 | A | S | B | 43 | A | A | | |
| T74 | 12 | C1 | 1.020 | 1.015 | S | S | B | 38 | A | A | | |
| T75 | 13 | C1 | 1.036 | 1.026 | A | S | B | 39 | B | B | | |
| T76 | 14 | C1 | 1.024 | 1.017 | S | S | B | 42 | A | A | | |
| T77 | 15 | C1 | 1.022 | 1.011 | S | S | S | 14 | A | A | | |
| T78 | 160 | C1 | 1.008 | 1.010 | S | S | S | 14 | A | A | | |
| T80 | 161 | C1 | 1.019 | 1.012 | S | S | S | 13 | A | A | 465 | 470 |
| T81 | 162 | C1 | 1.019 | 1.014 | S | S | S | 16 | A | A | | |
| T83 | 163 | C1 | 1.012 | 1.010 | S | S | A | 26 | A | A | | |
| T84 | 164 | C1 | 1.025 | 1.016 | S | S | B | 39 | A | A | | |
| T85 | 165 | C1 | 1.023 | 1.016 | S | S | B | 37 | A | A | 477 | 490 |
| T87 | 166 | C1 | 1.032 | 1.028 | A | S | A | 22 | A | B | | |
| T88 | 167 | C1 | 1.022 | 1.013 | S | S | B | 27 | A | A | | |
| T89 | 168 | C1 | 1.024 | 1.020 | S | S | A | 19 | A | A | | |
| T90 | 169 | C1 | 1.017 | 1.010 | S | S | S | 13 | A | A | 485 | 495 |
| T92 | 170 | C1 | 1.033 | 1.033 | A | S | B | 38 | A | A | 500 | 516 |

TABLE 11

| | | | After recrystallization heat treatment process | | | | After recovery heat treatment process | | | | | | |
|---|---|---|---|---|---|---|---|---|---|---|---|---|---|
| | | | Average grain size D0 after annealing process | Average grain size D1 | Precipitated particles Average particle size | Precipitated particles Percentage of particles of 4 to 25 nm | Characteristics of rolled material (0° direction) Tensile strength | Proof stress | Elongation | Conductivity | Balance index f2 | Characteristics of rolled material (90° direction) Tensile strength | Proof stress |
| Test No. | Alloy No. | Process No. | μm | μm | nm | % | N/mm$^2$ | N/mm$^2$ | % | % IACS | | N/mm$^2$ | N/mm$^2$ |
| T93 | 171 | C1 | | 2.7 | 4.4 | 75 | 555 | 530 | 6 | 36.4 | 3549 | 572 | 546 |
| T94 | 172 | C1 | | 3.2 | 6.5 | 87 | 531 | 520 | 8 | 36.3 | 3455 | 547 | 534 |
| T95 | 21 | C1 | | 9.5 | | | 475 | 454 | 8 | 37.3 | 3133 | 502 | 478 |
| T96 | | C3 | | 9.5 | | | 491 | 469 | 5 | 37.1 | 3140 | 520 | 495 |
| T97 | 22 | C1 | | 10.5 | | | 462 | 440 | 9 | 35.5 | 3000 | 488 | 462 |
| T98 | | C3 | | 10.5 | | | 479 | 455 | 6 | 35.5 | 3025 | 505 | 480 |
| T99 | 23 | C1 | | 1.9 | 3.3 | 30 | 547 | 530 | 4 | 35.7 | 3399 | 596 | 571 |
| T100 | 24 | C1 | | 2.2 | 3.4 | 30 | 542 | 528 | 4 | 34.8 | 3325 | 590 | 566 |
| T103 | 26 | C1 | | 8.5 | 18 | 85 | 457 | 436 | 9 | 39.2 | 3119 | 477 | 453 |
| T104 | | C3 | | 8.5 | 18 | 85 | 476 | 457 | 6 | 38.8 | 3143 | 500 | 476 |
| T105 | 27 | C1 | | 5.5 | 8 | 90 | 522 | 504 | 5 | 32.7 | 3134 | 554 | 538 |
| T106 | 28 | C1 | | 8.6 | 14 | 88 | 450 | 436 | 9 | 37.2 | 2992 | 471 | 452 |
| T107 | 29 | C1 | | 8.2 | 18 | 82 | 460 | 439 | 7 | 41.1 | 3155 | 479 | 456 |
| T108 | 30 | C1 | | 2.8 | 7 | 87 | 555 | 538 | 5 | 31.2 | 3255 | 584 | 562 |
| T109 | 31 | C1 | | 9.3 | 27 | 60 | 444 | 430 | 8 | 41.5 | 3089 | 466 | 448 |
| T110 | 32 | C1 | | 3.4 | 15 | 86 | 535 | 523 | 6 | 31 | 3157 | 575 | 554 |
| T111 | 33 | C1 | | 2 | 2.9 | 20 | 554 | 536 | 3 | 35.6 | 3405 | 592 | 566 |
| T112 | 34 | C1 | | 9 | 27 | 65 | 454 | 430 | 9 | 37.4 | 3026 | 471 | 444 |
| T113 | 35 | C1 | | 10 | 35 | 40 | 444 | 419 | 9 | 41 | 3099 | 464 | 435 |
| T114 | 36 | C1 | | 7.5 | 19 | 70 | 441 | 422 | 9 | 41.6 | 3100 | 463 | 441 |
| T115 | | C3 | | | | | 460 | 439 | 6 | 41.3 | 3134 | 486 | 461 |
| T116 | 37 | C1 | | 9.5 | 26 | 60 | 437 | 416 | 9 | 39.8 | 3005 | 456 | 434 |
| T117 | | C3 | | | | | 454 | 430 | 7 | 39.8 | 3065 | 479 | 452 |
| T118 | 38 | C1 | | 1.8 | | | 555 | 533 | 3 | 35.5 | 3406 | 594 | 563 |

TABLE 12

| | | | After recovery heat treatment process | | | | | | | | | |
|---|---|---|---|---|---|---|---|---|---|---|---|---|
| | | | Ratio of 90° tensile strength | Ratio of 90° proof stress | Bending workability | | Stress relaxation rate | | Stress corrosion cracking resistance | | Spring deflection limit | |
| Test | Alloy | Process | to 0° tensile | to 0° proof | 90° direction | 0° direction | | | Stress corrosion | Stress corrosion | 0° direction | 90° direction |
| No. | No. | No. | strength | stress | Bad Way | Good Way | | % | 1 | 2 | N/mm$^2$ | N/mm$^2$ |
| T93 | 171 | C1 | 1.031 | 1.030 | A | S | B | 41 | A | A | | |
| T94 | 172 | C1 | 1.030 | 1.027 | S | S | A | 19 | A | A | 504 | 516 |
| T95 | 21 | C1 | 1.057 | 1.053 | A | S | C | 62 | A | A | 370 | 408 |
| T96 | | C3 | 1.059 | 1.055 | B | S | C | 64 | A | A | | |
| T97 | 22 | C1 | 1.056 | 1.050 | B | S | B | 40 | A | A | 355 | 398 |
| T98 | | C3 | 1.054 | 1.055 | B | S | C | 42 | A | A | 372 | 416 |
| T99 | 23 | C1 | 1.090 | 1.077 | C | B | C | 61 | A | A | 475 | 513 |
| T100 | 24 | C1 | 1.089 | 1.072 | C | B | B | 28 | A | B | | |
| T103 | 26 | C1 | 1.044 | 1.039 | A | S | B | 34 | A | A | | |
| T104 | | C3 | 1.050 | 1.042 | A | S | B | 37 | A | A | | |
| T105 | 27 | C1 | 1.061 | 1.067 | C | S | C | 59 | B | C | | |
| T106 | 28 | C1 | 1.047 | 1.037 | A | S | B | 31 | A | A | | |
| T107 | 29 | C1 | 1.041 | 1.039 | S | S | C | 64 | A | A | 345 | 390 |
| T108 | 30 | C1 | 1.052 | 1.045 | B | A | C | 59 | B | B | | |
| T109 | 31 | C1 | 1.050 | 1.042 | A | S | B | 40 | A | A | | |
| T110 | 32 | C1 | 1.075 | 1.059 | B | A | B | 31 | B | C | 442 | 513 |
| T111 | 33 | C1 | 1.069 | 1.056 | C | B | C | 61 | A | A | | |
| T112 | 34 | C1 | 1.037 | 1.033 | A | S | A | 22 | A | A | | |
| T113 | 35 | C1 | 1.045 | 1.038 | S | S | B | 30 | A | A | | |
| T114 | 36 | C1 | 1.050 | 1.045 | S | S | B | 36 | A | A | | |
| T115 | | C3 | 1.057 | 1.050 | A | S | B | 37 | A | A | | |
| T116 | 37 | C1 | 1.043 | 1.043 | A | S | B | 28 | A | A | 345 | 370 |
| T117 | | C3 | 1.055 | 1.051 | A | S | B | 31 | A | A | 345 | 370 |
| T118 | 38 | C1 | 1.070 | 1.056 | C | B | C | 61 | A | A | | |

Measurement of tensile strength, proof stress, and elongation was performed according to a method defined in JIS Z 2201, and JIS Z 2241, and with regard to a shape of a test specimen, a test specimen of No. 5 was used.

Measurement of conductivity was performed using a conductivity measuring device (SIGMATEST D2. 068) manufactured by FOERSTER JAPAN Limited. In addition, in this specification, "electrical conduction" and "conduction" are used with the same meaning. In addition, thermal conductivity and electric conductivity have a strong relationship. Accordingly, high conductivity represents that thermal conductivity is good.

Bending workability was evaluated by W bending of a bending angle of 90°, which is defined in JIS H 3110. A bending test (W bending) was performed as follows. A bend radius (R) at the front end of a bending jig was set to 0.67 times a material thickness (0.3 mm×0.67=0.201 mm, a bend radius=0.2 mm), 0.33 times the material thickness (0.3 mm×0.33=0.099 mm, a bend radius=0.1 mm), and 0 times the material thickness (0.3 mm×0=0 mm, a bend radius=0 mm), respectively. Samples were collected in a direction making an angle of 90° with a rolling direction which is called Bad Way, and in a direction making an angle of 0° with the rolling direction which is called Good Way. With regard to determination of the bending workability, whether or not a cracking was present was determined using a stereoscopic microscope with a magnification of 20 times. A sample in which cracking did not occur with a bend radius of 0.33 times a material thickness was evaluated as A. A sample in which cracking did not occur with a bend radius of 0.67 times the material thickness was evaluated as B. A sample in which cracking occurred with a bend radius of 0.67 times the material thickness was evaluated as C. Particularly, as a material excellent in bending workability, a sample in which cracking did not occur with a bend radius of 0 times the material thickness was evaluated as S. The problem of the invention relates to excellent total balance of strength and the like, and excellent bending workability, and thus evaluation of the bending workability was performed in a strict manner.

Measurement of the stress relaxation rate was performed as follows. In a stress relaxation test of a material under test, a cantilever screw type jig was used. Test specimens were collected in a direction making an angle of 0° (parallel) with the rolling direction, and a shape of the test specimens was set to have sheet thickness t×width of 10 mm×length of 60 mm. A load stress to the material under test was set to 80% of 0.2% proof stress, and the material under test was exposed to an atmosphere of 150° C. for 1000 hours. The stress relaxation rate was obtained by the following expression.

$$\text{Stress relaxation rate}=(\text{displacement after opening}/\text{displacement during stress load})\times 100(\%)$$

In the invention, it is preferable that the stress relaxation rate have a small value.

With regard to the test specimens collected in a direction parallel with the rolling direction, a test specimen in which the stress relaxation rate was 25% or less was evaluated as A (excellent), a test specimen in which the stress relaxation rate was greater than 25% and equal to or less than 40% was evaluated as B (possible), a test specimen in which the stress relaxation rate exceeded 40% was evaluated as C (impossible), and a test specimen in which the stress relaxation rate was 17% or less was evaluated as S (particularly excellent).

In addition, with regard to rolled materials that were produced in the production process A1, the production process A31, the production process B1, and the production process C1, test specimens were also collected in a direction making an angle of 90° (perpendicular) with the rolling direction, and were tested. With regard to rolled materials that were produced in the production process A1, the production process A31, the production process B1, and the production process C1, the average of stress relaxation rates in both of the test specimen collected in a direction parallel with the rolling direction, and the test specimen collected in a direction perpendicular to the rolling direction is shown in Tables 3 to 12. The stress relaxation rate of the test specimen collected in a direction perpendicular to the rolling direction is larger than that of the test specimen collected in the parallel direction, that is, stress relaxation characteristics are poor.

Measurement of the stress corrosion cracking resistance was performed using a test vessel and a test solution which are defined in JIS H 3250, and a solution obtained by mixing aqueous ammonia and water in the same amounts was used.

First, a residual stress was mainly applied to a rolled material, and the stress corrosion cracking resistance was evaluated. Evaluation was performed by exposing the test specimen, which was subjected to the W bending at R (radius: 0.6 mm) of two times the sheet thickness using the method used in the evaluation of the bending workability, to an ammonia atmosphere. A test container and a test solution, which are defined in JIS H 3250, were used. The test specimen was exposed to ammonia using a solution obtained by mixing aqueous ammonia and water in the same amounts, and the test specimen was washed with sulfuric acid. Then, whether or not cracking was present was examined using a stereoscopic microscope with a magnification of 10 times to evaluate the stress corrosion cracking resistance. A test specimen in which cracking had not occurred through exposure for 48 hours was evaluated as A excellent in the stress corrosion cracking resistance, a test specimen in which cracking occurred through exposure for 48 hours, but cracking did not occur through exposure for 24 hours was evaluated as B satisfactory in the stress corrosion cracking resistance (without a problem in practical use), and a specimen in which cracking occurred through exposure for 24 hours was evaluated as C inferior in the stress corrosion cracking resistance (with a problem in practical use). These results are shown in a column of stress corrosion 1 of the stress corrosion cracking resistance in Tables 3 to 12.

In addition, the stress corrosion cracking resistance was evaluated by another method separately from the above-described evaluation.

In the other stress corrosion cracking resistance test, to examine sensitivity of the stress corrosion cracking resistance with respect to a stress that was applied, a rolled material, to which a bending stress of 80% of the proof stress was applied using a cantilever screw type jig formed from a resin, was exposed to the ammonia atmosphere, and the stress corrosion cracking resistance was evaluated from a stress relaxation rate. That is, when minute cracking occurs, and a degree of the cracking increases without returning to the original state, the stress relaxation rate increases, and thus the stress corrosion cracking resistance may be evaluated. A test specimen in which the stress relaxation rate through exposure for 48 hours was 25% or less was evaluated as A excellent in the stress corrosion cracking resistance, a test specimen in which the stress relaxation rate through exposure for 48 hours exceeded 25%, but the stress relaxation rate through exposure for 24 hours was 25% or less was evaluated as B satisfactory in the stress corrosion cracking resistance (without a problem in practical use), and a test specimen in which the stress relaxation rate through exposure for 24 hours exceeded 25% was evaluated as C inferior in the stress corrosion cracking resistance (with a problem in practical use). These results are shown in a column of stress corrosion 2 of the stress corrosion cracking resistance in Tables 3 to 12.

In addition, the stress corrosion cracking resistance that is required in the invention is stress corrosion cracking resistance with the assumption of high reliability and a harsh case.

Measurement of the spring deflection limit was performed according to a method described in JIS H 3130, and evaluation was performed by a repetitive deflection type test. The test was performed until an amount of permanent deflection exceeded 0.1 mm.

Measurement of an average grain size of recrystallized grains was performed using a metallurgical microscope photograph with a magnification of 600 times, 300 times, 150 times, and the like, and the magnification was appropriately selected depending on the size of the crystal grains. The average grain size was measured according to quadrature in a method for estimating average grain size of wrought copper and copper-alloys in JIS H 0501. In addition, a twin crystal is not considered as a crystal grain. The average grain size, which was difficult to determine using the metallurgical microscope, was obtained using a FE-SEM/EBSP (Electron Back Scattering diffraction Pattern) method. That is, the average grain size was obtained from a grain size map (Grain map) with an analysis magnification of 200 times and 500 times by using JSM-7000 F manufactured by JEOL Ltd. as the FE-SEM, and TSL solutions OIM-Ver. 5.1 for analysis. The average grain size was calculated by a method according to quadrature (JIS H 0501).

In addition, one crystal grain elongates by rolling, but a volume of the crystal grain substantially does not vary due to the rolling. When an average value of average grain sizes, which are measured according to quadrature on cross-sections obtained by cutting a sheet material in a direction parallel with the rolling direction and in a direction perpendicular to the rolling direction, respectively, is obtained, an average grain size at a recrystallization stage may be estimated.

The average particle size of precipitates was obtained as follows. In transmission electron images obtained by a TEM with a magnification of 500,000 times and 150,000 times (detection limits: 1.0 nm and 3 nm, respectively), the contrast of the precipitates was approximated to an ellipse using image analysis software "Win ROOF", geometrical mean values of the major axis and the minor axis in the ellipse were obtained with respect to all of the precipitated particles within a visual field, and an average value thereof was set as an average particle size. In addition, in measurement at a magnification of 500,000 times and measurement at a magnification of 150,000 times, detection limits of the particle size were set to 1.0 nm and 3 nm, respectively, a particle size less than the detection limits was treated as noise, and was not included for calculation of the average particle size. In addition, approximately 8 nm was made as a boundary, an average particle size equal to or less than the boundary was measured at a magnification of 500,000 times, and an average particle size equal to greater than the boundary was measured at a magnification of 150,000 times. In the case of the transmission electron microscope, since a dislocation density is high in a cold-worked material, it is difficult to correctly grasp information of precipitates. In addition, the size of the precipitates does not vary depending on cold working, and thus the observation at this time was performed with respect to a recrystallized portion after the recrystallization heat treatment process before the finish cold rolling process. A measurement position was set to two sites located at a depth of ¼ times the sheet thickness from both of a front surface and a rear surface of the rolled material, and measured values of the two sites were averaged.

Test results are shown below.

(1) A first alloy of the invention, which was obtained by finish cold-rolling the rolled material in which the average grain size after the recrystallization heat treatment process was 2.0 μm to 8.0 μm, and the average particle size of the precipitates was 4.0 nm to 25.0 nm, or the percentage of the number of precipitates having a particle size of 4.0 nm to 25.0 nm made up 70% or more of the precipitates, was excellent in the tensile strength, the proof stress, the conductivity, the bending workability, the stress corrosion cracking resistance, and the like (refer to test Nos. T30, T43, and T67).

(2) A second alloy of the invention, which was obtained by finish cold-rolling the rolled material in which the average grain size after the recrystallization heat treatment process was 2.5 μm to 7.5 μm, and the average particle size of the precipitates was 4.0 nm to 25.0 nm, or the percentage of the number of precipitates having a particle size of 4.0 nm to 25.0 nm made up 70% or more of the precipitates, was excellent in the tensile strength, the proof stress, the conductivity, the bending workability, the stress corrosion cracking resistance, and the like (refer to test Nos. T8, T22, T56, and T72).

(3) A third alloy of the invention, which was obtained by finish cold-rolling the rolled material in which the average grain size after the recrystallization heat treatment process was 2.0 μm to 8.0 μm, and the average particle size of the precipitates was 4.0 nm to 25.0 nm, or the percentage of the number of precipitates having a particle size of 4.0 nm to 25.0 nm made up 70% or more of the precipitates, was excellent in, particularly, the tensile strength, and had satisfactory proof stress, conductivity, bending workability, stress corrosion cracking resistance, and the like (refer to test Nos. T92, T93, and T94).

(4) According to the first alloy, the second alloy, or the third alloy of the invention, which was obtained by finish cold-rolling the rolled material in which the average grain size after the recrystallization heat treatment process was 2.0 μm to 8.0 μm, and the average particle size of the precipitates was 4.0 nm to 25.0 nm, or the percentage of precipitates having a particle size of 4.0 nm to 25.0 nm made up 70% or more of the precipitates, a copper alloy sheet, in which conductivity was 32% IACS or more, tensile strength was 500 N/mm$^2$ or more, $3200 \leq f2 \leq 4000$, a ratio of the tensile strength in a direction making an angle of 0° with the rolling direction to the tensile strength in a direction making an angle of 90° with the rolling direction was 0.95 to 1.05, and a ratio of the proof stress in a direction making an angle of 0° with the rolling direction to the proof stress in a direction making an angle of 90° with the rolling direction was 0.95 to 1.05, was obtained. The rolled material was excellent in the tensile strength, the proof stress, the conductivity, the bending workability, the stress corrosion cracking resistance, and the like (refer to test Nos. T8, T22, T30, T43, T56, T67, and T72).

(5) The first alloy, the second alloy, or the third alloy of the invention, which was obtained by finish cold-rolling the rolled material in which the average grain size after the recrystallization heat treatment process was 2.0 μm to 8.0 μm, and the average particle size of the precipitates was 4.0 nm to 25.0 nm, or the percentage of precipitates having a particle size of 4.0 nm to 25.0 nm made up 70% or more of the precipitates, and by subjecting the resultant rolled material to the recovery heat treatment process, was excellent in the tensile strength, the proof stress, the conductivity, the bending workability, the stress corrosion cracking resistance, the spring deflection limit, and the like (refer to test Nos. T1, T15, T23, T37, T50, T63, T68, T92, T93, T94, and the like).

(6) According to the first alloy or the second alloy of the invention, which was obtained by finish cold-rolling the rolled material in which the average grain size after the recrystallization heat treatment process was 2.0 μm to 8.0 μm, and the average particle size of the precipitates was 4.0 nm to 25.0 nm, or the percentage of precipitates having a particle size of 4.0 nm to 25.0 nm made up 70% or more of the precipitates, and by subjecting the resultant rolled material to the recovery heat treatment, a copper alloy sheet, in which conductivity was 32% IACS or more, the tensile strength was 500 N/mm$^2$ or more, 3200≤f2≤4000, the ratio of the tensile strength in a direction making an angle of 0° with the rolling direction to the tensile strength in a direction making an angle of 90° with the rolling direction was 0.95 to 1.05, and a ratio of proof stress in a direction making an angle of 0° with the rolling direction to proof stress in a direction making an angle of 90° with the rolling direction was 0.95 to 1.05, was obtained. The rolled material was excellent in the tensile strength, the proof stress, the conductivity, the bending workability, the stress corrosion cracking resistance, the spring deflection limit, and the like (refer to test Nos. T1, T15, T23, T37, T50, T63, T68, T92, T93, T94, and the like).

In the third alloy of the invention, which further contained Fe, the precipitated particles were slightly fine, but strength was high due to operation of suppressing growth of crystal grains.

(7) The copper alloy sheet according to (1) and (2) could be obtained by the following production conditions. The hot rolling process, the cold rolling process, the recrystallization heat treatment process, and the finish cold rolling process were included in this order. The hot rolling initiation temperature of the hot rolling process was 800° C. to 940° C., the cooling rate of the copper alloy material in a temperature region from a temperature after final rolling or 650° C. to 350° C. was 1° C./second or more, and the cold working rate in the cold rolling process was 55% or more. In addition, in the recrystallization heat treatment process, the highest arrival temperature Tmax (° C.) of the rolled material satisfied 550≤Tmax≤790, the retention time tm (min) satisfied 0.04≤tm≤2, and the heat treatment index It satisfied 460≤It≤580 (refer to test Nos. T8, T22, T30, T43, T56, T67, and T72).

(8) The copper alloy sheet according to (5) could be obtained by the following production conditions. The hot rolling process, the cold rolling process, the recrystallization heat treatment process, the finish cold rolling process, and the recovery heat treatment process were included in this order. The hot rolling initiation temperature of the hot rolling process was 800° C. to 940° C., the cooling rate of the copper alloy material in a temperature region from a temperature after final rolling or 650° C. to 350° C. was 1° C./second or more, and the cold working rate in the cold rolling process was 55% or more. In addition, in the recrystallization heat treatment process, the highest arrival temperature Tmax (° C.) of the rolled material satisfied 550≤Tmax≤790, the retention time tm (min) satisfied 0.04≤tm≤2, and the heat treatment index It satisfied 460≤It≤580. In addition, in the recovery heat treatment process, the highest arrival temperature Tmax2 (° C.) of the rolled material satisfied 160≤Tmax2≤650, the retention time tm2 (min) satisfied 0.02≤tm≤200, and the heat treatment index It satisfied 100≤It≤360 (refer to test Nos. T1, T15, T23, T37, T50, T63, T68, T92, T93, T94, and the like).

In a case of using the alloys of the invention, the following effects were obtained.

(1) In the production process A using a mass production facility, and the production process B using a laboratory facility, when production conditions were the same as each other, the same characteristics were obtained (refer to test Nos. T1, T23, and the like).

(2) In a case where the production conditions were within set conditions of the invention, and the amount of Ni was large, and [Ni]/[P] was 8 or more, the stress relaxation rate was satisfactory (refer to test Nos. T1, T50, T68, and the like).

(3) In a case where the production conditions were within set conditions of the invention, even when the amount of Ni was low, the stress relaxation rate was B or more (refer to test Nos. T37, T63, and the like).

(4) In a case where the average grain size was as large as 3.5 μm to 5.0 μm in comparison to a case in which the average grain size was 2 μm 3.5 μm, or in a case of the process A3 in comparison to the process A1, the tensile strength was slightly lower, but the stress relaxation characteristics were further improved (refer to test Nos. T15, T19, and the like).

(5) In a case where the average recrystallized grain size after the recrystallization heat treatment process was 2.5 μm to 4.0 μm, respective characteristics such as the tensile strength, the proof stress, the conductivity, the bending workability, and the stress corrosion cracking resistance were satisfactory (refer to test Nos. T1, T3, T15, T17, and the like). In addition, when the average recrystallized grain size was 2.5 μm to 5.0 μm, the ratio of the tensile strength or the proof stress in a direction making an angle of 0° with the rolling direction to the tensile strength or the proof stress in a direction making an angle of 90° with the rolling direction were 0.98 to 1.03, respectively, and thus directionality was substantially not present (refer to test Nos. T1, T2, T3, T5, T6, and the like).

(6) In a case where the average recrystallized grain size after the recrystallization heat treatment process was less than 2.5 μm, and particularly, less than 2.0 μm, bending workability deteriorated (refer to test Nos. T18, T39, and the like). In addition, the ratio of the tensile strength or the proof stress in a direction making an angle of 0° with the rolling direction to the tensile strength or the proof stress in a direction making an angle of 90° with the rolling direction deteriorated. In addition, the stress relaxation characteristics also deteriorated.

In a case where the average recrystallized grain size was less than 2.0 μm, even when the cold working rate in the final finish cold rolling was set to be low, the bending workability or the directionality was not so improved (refer to test No. T40).

(7) In a case where the average recrystallized grain size after the recrystallization heat treatment process was greater than 8.0 μm, the tensile strength decreased (refer to test Nos. T7, T29, and the like).

(8) In a case where the heat treatment index It in the recrystallization heat treatment process was less than 460, the average grain size after the recrystallization heat treatment process decreased, and thus the bending workability, and the stress relaxation rate deteriorated (refer to test No. T18, and the like). In addition, in a case where It was less than 460, the average particle size of the precipitated particles decreased, and thus the bending workability deteriorated (refer to test Nos. T18, T39, and the like). In addition, the ratio of the tensile strength or the proof stress in a direction making an angle of 0° with the rolling direction to the tensile strength or the proof stress in a direction making an angle of 90° with the rolling direction deteriorated.

(9) In a case where the heat treatment index It in the recrystallization heat treatment process was greater than 580, the average particle size of the precipitated particles after the recrystallization heat treatment process increased, and thus the tensile strength and the conductivity decreased. In addition, the directionality of the tensile strength or the proof stress deteriorated (refer to Test Nos. T7, T21, and the like).

(10) In a case where the cooling rate after the hot rolling was less than a set condition range, it entered a precipitation state in which the average particle size of the precipitated particles slightly increased, and the precipitated particles were not uniform. Accordingly, the tensile strength was low, and the stress relaxation characteristics deteriorated (refer to test Nos. T10, T32, and the like).

In the copper alloy sheet, which was subjected to a heat treatment with It of 565 and 566 in the vicinity of the upper limit of the condition range (460 to 580) of the heat treatment index It in the recrystallization heat treatment process, respectively, the average grain size slightly increased to approximately 5 μm, and the tensile strength slightly decreased, but precipitated particles were uniformly distributed. Accordingly, the stress relaxation characteristics were good (refer to test Nos. T5, T6, T19, T20, T27, T28, T53, T54, and the like). When the cold working rate in the final finish cold rolling was set to be high, in the rolled alloy materials of the invention, the strength was improved without deteriorating the bending workability and the stress relaxation characteristics (refer to test Nos. T6, T20, T28, T54, and the like).

(11) In a case where the temperature conditions in the annealing process were 580° C.×4 hours, or in a case where the cold working rate in the second cold rolling process was less than the set condition range, a relationship of $D0 \leq D1 \times 4 \times (RE/100)$ was not satisfied, and thus it entered a mixed grain size state in which crystal grains having a large recrystallized grain size and crystal grains having a small recrystallized grain size were mixed after the recrystallization heat treatment process. As a result, the average grain size slightly increased, and thus the directionality of the tensile strength or the proof stress occurred, and the bending workability deteriorated (refer to test Nos. T14, T36, and the like).

(12) In a case where a second cold rolling rate was low, it entered a mixed grain size state in which crystal grains having a large recrystallized grain size and crystal grains having a small recrystallized grain size were mixed after the recrystallization heat treatment process. As a result, the average grain size slightly increased, and thus the directionality of the tensile strength or the proof stress occurred, and the bending workability deteriorated (refer to test Nos. T12, T34, and the like).

Compositions were as follows.

(1) In a case of adding P, Co, and Ni, when the contents thereof were less than the condition range of the second alloy of the invention, the average grain size after the recrystallization heat treatment process increased, and the balance index f2 decreased. Accordingly, the tensile strength decreased, and thus the directionality of the tensile strength or the proof stress occurred (refer to test Nos. T95, T97, and the like).

(2) In a case where the contents of P and Co were greater than the condition range of the first alloy of the invention, a specific effect of P and Co, and the average grain size of the precipitated particles after the recrystallization heat treatment process decreased, and thus the average grain size decreased, and the balance index f2 decreased. The directionality of the tensile strength or the proof stress, the bending workability, and the stress relaxation rate deteriorated (refer to test Nos. T99, T100, and the like).

(3) In a case where the contents of Zn and Sn were less than the condition range of the first alloy of the invention, the average grain size after the recrystallization heat treatment process increased, the tensile strength decreased, and the balance index f2 decreased. In addition, the directionality of the tensile strength or the proof stress deteriorated, and thus the stress relaxation rate deteriorated (refer to test Nos. T103, T106, and the like). Particularly, even when Ni was contained, an effect appropriate for the content of Ni was not obtained, and the stress relaxation characteristics deteriorated.

The content of Zn in the vicinity of 4.5% by mass was a boundary value for satisfying the balance index f2, the tensile strength, and the stress relaxation characteristics (refer to alloy Nos. 160, 161, 162, 163, 26, 37, and the like).

The content of Sn in the vicinity of 0.4% by mass was a boundary value for satisfying the balance index f2, the tensile strength, and the stress relaxation characteristics (refer to alloy Nos. 166, 168, 28, and the like).

(4) In a case where the content of Zn was greater than the condition range of the alloy of the invention, the balance index f2 was small, and the conductivity, the directionality of the tensile strength or the proof stress, the stress relaxation rate, and the bending workability deteriorated. In addition, the stress corrosion cracking resistance also deteriorated (refer to test No. T105, and the like).

In a case where the content of Sn was large, the conductivity deteriorated, and the bending workability was not so good (refer to No. T108).

In an alloy in which when the content of Ni exceeded 0.35% by mass, the stress relaxation characteristics were excellent, and when a value of Ni/Sn deviated from 0.6 to 1.8, an effect appropriate for the content of Ni was not obtained, and the stress relaxation characteristics were not so good (refer to alloy Nos. 15, 162, 167, 168, 169, and the like).

(5) In a case where the composition index f1 was lower than the condition range of the first alloy of the invention, the average grain size after the recrystallization heat treatment process was large, the tensile strength was low, and the directionality of the tensile strength or the proof stress was poor. In addition, the stress relaxation rate was poor (refer to test Nos. T107, T109, and the like). Particularly, even when Ni was contained, an effect appropriate for the content of Ni was not obtained, and the stress relaxation characteristics were also poor. In addition, with regard to the value of the composition index f1, a value of approximately 11 was a boundary value for satisfying the balance index f2, the tensile strength, and the stress relaxation characteristics (refer to alloy Nos. 163, 164, 29, 31, 35, 36, and the like). In addition, when the value of the composition index f1 exceeded 12, the balance index f2, the tensile strength, and the stress relaxation characteristics were further improved (refer to alloy Nos. 162, 165, and the like).

(6) In a case where the composition index f1 was higher than the condition range of the first alloy of the invention, the conductivity was low, the balance index f2 was small, and the directionality of the tensile strength and the proof stress was poor. In addition, the stress corrosion cracking resistance and the stress relaxation rate were also poor (refer to test Nos. T108, T110, and the like). In addition, with regard to the composition index f1, a value of approximately 17 was a boundary value for satisfying the balance index f2, the conductivity, the stress corrosion cracking resistance, the stress relaxation characteristics, and the directionality (refer to alloy Nos. 30, 32, and 166). Furthermore, when the value of the composition index f1 was smaller than 16, the balance index f2, the conductivity, the stress corrosion cracking resistance, the stress relaxation characteristics, and the directionality of the tensile strength or the proof stress were improved (refer to alloy No. 7).

As described above, even when the concentrations of Zn, Sn, Ni, Co, and the like were within a predetermined concentration range, when the value of the composition index f1 deviated from a range of 11 to 17, and preferably a range of 11 to 16, any of the balance index f2, the conductivity, the stress corrosion cracking resistance, the stress relaxation characteristics, and the directionality was not satisfied.

Even when Fe was contained, the balance index f2 was sufficiently satisfied. Due to Fe being contained, the particle size of the precipitates decreased, and the average grain size became 3.5 μm or less. Accordingly, in a case where a high value was set on the tensile strength, this decrease in grain size was a satisfactory thing, but the stress relaxation characteristics, and the bending workability slightly deteriorated (refer to test Nos. T92, T93, T94, and the like).

(7) In a case where the alloy composition was within the condition range of the alloy of the invention, the bending workability, and the directionality of the tensile strength or the proof stress were satisfactory. However, when the sum of the content of Fe and the content of Co was as much as 0.09% by mass, the average particle size of the precipitated particles after the recrystallization heat treatment process further decreased in comparison to a copper alloy sheet in which the sum of the content of Fe and the content of Co was 0.05% by mass or less. Accordingly, the average grain size decreased, and thus the bending workability and the directionality of the tensile strength and the proof stress were poor, and the stress relaxation rate was poor (refer to test No. T111).

In a case where 0.05% by mass of Cr was contained, the average grain size decreased, and thus the bending workability, and the directionality were poor, and the stress relaxation rate was poor (refer to test No. T118).

INDUSTRIAL APPLICABILITY

In the copper alloy sheet of the invention, strength is high, corrosion resistance is satisfactory, a balance of conductivity, tensile strength, and elongation is excellent, and directionality of tensile strength and proof stress is not present. Accordingly, the copper alloy sheet of the invention is suitably applicable to a constituent material such as a connector, a terminal, a relay, a spring, and a switch.

The invention claimed is:

1. A method of producing a copper alloy sheet, the method comprising: in this order, subjecting an ingot to a hot rolling process to obtain a copper alloy material;

subjecting the copper alloy material to a cold rolling process;

subjecting the copper alloy material to a recrystallization heat treatment process; and subjecting the copper alloy material to a finish cold rolling process to provide a copper alloy sheet, wherein a hot rolling initiation temperature of the hot rolling process is 800° C. to 940° C., and a cooling rate of the copper alloy material in a temperature region from a temperature after final rolling or 650° C. to 350° C. is 1° C./second or more, a cold working rate in the cold rolling process is 55% or more, the recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recrystallization heat treatment process, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and the cold working rate at the cold rolling process is set as RE (%), $550 \leq Tmax \leq 790$, $0.04 \leq tm \leq 2$, and $460 \leq \{Tmax - 40 \times tm^{-1/2} - 50 \times (1 - RE/100)^{1/2}\} \leq 580$, an average grain size of the copper alloy material before the finish cold rolling process is 2.0 μm to 8.0 μm, circular or elliptical precipitates are present in the copper alloy material before the finish cold rolling process, and an average particle size of the precipitates is 4.0 nm to 25.0 nm, or a percentage of the number of precipitates having a particle size of 4.0 nm to 25.0 nm makes up 70% or more of the precipitates, the copper alloy sheet contains 4.5% by mass to 12.0% by mass of Zn, 0.40% by mass to 0.90% by mass of Sn, 0.01% by mass to 0.08% by mass of P, and either one or both of 0.005% by mass to 0.08% by mass of Co and 0.03% by mass to 0.85% by mass of Ni, with the remainder being Cu and unavoidable impurities, and

[Zn], [Sn], [P], [Co], and [Ni] satisfy a relationship of $11 \leq [Zn] + 7 \times [Sn] + 15 \times [P] + 12 \times [Co] + 4.5 \times [Ni] \leq 17$, wherein [Zn], [Sn], [P], [Co], and [Ni] represent the contents % by mass of Zn, Sn, P, Co, and Ni, respectively.

2. A method of producing a copper alloy sheet, the method comprising: in this order, subjecting an ingot to a hot rolling process to obtain a copper alloy material;

subjecting the copper alloy material to a cold rolling process;

subjecting the copper alloy material to a recrystallization heat treatment process;

subjecting the copper alloy material to a finish cold rolling process; and subjecting the copper alloy material to a recovery heat treatment process in this order to provide a copper alloy sheet, wherein a hot rolling initiation temperature of the hot rolling process is 800° C. to 940° C., and a cooling rate of the copper alloy material in a temperature region from a temperature after final rolling or 650° C. to 350° C. is 1° C./second or more, a cold working rate in the cold rolling process is 55% or more, the recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recrystallization heat treatment process, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and the cold working rate at the cold rolling process is set as RE (%), $550 \leq Tmax \leq 790$, $0.04 \leq tm \leq 2$, and $460 \leq \{Tmax - 40 \times tm^{-1/2} - 50 \times (1 - RE/100)^{1/2}\} \leq 580$, the recovery heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recovery heat treatment process, when the highest arrival temperature of the copper alloy material is set as Tmax2 (° C.), a retention time in a temperature range from a temperature lower than the highest arrival temperature of the copper alloy material by 50° C. to the highest arrival temperature is set as tm2 (min), and a cold working rate at the finish cold rolling process is set as RE2(%), $160 \leq Tmax2 \leq 650$, $0.02 \leq tm2 \leq 200$, and $100 \leq \{Tmax2-40\times tm2^{-1/2}-50\times(1-RE2/100)^{1/2}\} \leq 360$, an average grain size of the copper alloy material before the finish cold rolling process is 2.0 μm to 8.0 μm, circular or elliptical precipitates are present in the copper alloy material before the finish cold rolling process, and an average particle size of the precipitates is 4.0 nm to 25.0 nm, or a percentage of the number of precipitates having a particle size of 4.0 nm to 25.0 nm makes up 70% or more of the precipitates, the copper alloy sheet contains 4.5% by mass to 12.0% by mass of Zn, 0.40% by mass to 0.90% by mass of Sn, 0.01% by mass to 0.08% by mass of P, and either one or both of 0.005% by mass to 0.08% by mass of Co and 0.03% by mass to 0.85% by mass of Ni, with the remainder being Cu and unavoidable impurities, and

[Zn], [Sn], [P], [Co], and [Ni] satisfy a relationship of $11 \leq [Zn]+7\times[Sn]+15\times[P]+12\times[Co]+4.5\times[Ni] \leq 17$, wherein [Zn], [Sn], [P], [Co], and [Ni] represent the contents % by mass of Zn, Sn, P, Co, and Ni, respectively.

3. A method of producing a copper alloy sheet, the method comprising: in this order, subjecting an ingot to a hot rolling process to obtain a copper alloy material;

subjecting the copper alloy material to a cold rolling process;

subjecting the copper alloy material to a recrystallization heat treatment process; and subjecting the copper alloy material to a finish cold rolling process, wherein a hot rolling initiation temperature of the hot rolling process is 800° C. to 940° C., and a cooling rate of the copper alloy material in a temperature region from a temperature after final rolling or 650° C. to 350° C. is 1° C./second or more, a cold working rate in the cold rolling process is 55% or more, the recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recrystallization heat treatment process, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and the cold working rate at the cold rolling process is set as RE (%), $550 \leq Tmax \leq 790$, $0.04 \leq tm \leq 2$, and $460 \leq \{Tmax-40\times tm^{-1/2}-50\times(1-RE/100)^{1/2}\} \leq 580$, an average grain size of the copper alloy material before the finish cold rolling process is 2.5 μm to 7.5 μm, circular or elliptical precipitates are present in the copper alloy material before the finish cold rolling process, and an average particle size of the precipitates is 4.0 nm to 25.0 nm, or a percentage of the number of precipitates having a particle size of 4.0 nm to 25.0 nm makes up 70% or more of the precipitates, the copper alloy sheet contains 4.5% by mass to 10.0% by mass of Zn, 0.40% by mass to 0.85% by mass of Sn, 0.01% by mass to 0.08% by mass of P, and either one or both of 0.005% by mass to 0.05% by mass of Co and 0.35% by mass to 0.85% by mass of Ni, with the remainder being Cu and unavoidable impurities, and

[Zn], [Sn], [P], [Co], and [Ni] satisfy a relationship of $11 \leq [Zn]+7\times[Sn]+15\times[P]+12\times[Co]+4.5\times[Ni] \leq 16$, wherein [Zn], [Sn], [P], [Co], and [Ni] represent the contents % by mass of Zn, Sn, P, Co, and Ni, respectively, and wherein when the content of Ni is 0.35% by mass to 0.85% by mass then a relationship: $8 \leq [Ni]/[P] \leq 40$ is satisfied.

4. A method of producing a copper alloy sheet, the method comprising: in this order, subjecting an ingot to a hot rolling process to obtain a copper alloy material;

subjecting the copper alloy material to a cold rolling process;

subjecting the copper alloy material to a recrystallization heat treatment process;

subjecting the copper alloy material to a finish cold rolling process; and subjecting the copper alloy material to a recovery heat treatment process, wherein a hot rolling initiation temperature of the hot rolling process is 800° C. to 940° C., and a cooling rate of the copper alloy material in a temperature region from a temperature after final rolling or 650° C. to 350° C. is 1° C./second or more, a cold working rate in the cold rolling process is 55% or more, the recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recrystallization heat treatment process, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and the cold working rate at the cold rolling process is set as RE (%), $550 \leq Tmax \leq 790$, $0.04 \leq tm \leq 2$, and $460 \leq \{Tmax-40\times tm^{-1/2}-50\times(1-RE/100)^{1/2}\} \leq 580$, the recovery heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recovery heat treatment process, when the highest arrival temperature of the copper alloy material is set as Tmax2 (° C.), a retention time in a temperature range from a temperature lower than the highest arrival temperature of the copper alloy material by 50° C. to the highest arrival temperature is set as tm2 (min), and a cold working rate at the finish cold rolling process is set as RE2(%), $160 \leq Tmax2 \leq 650$, $0.02 \leq tm2 \leq 200$, and $100 \leq \{Tmax2-40 \times tm2^{-1/2}-50 \times (1-RE2/100)^{-1/2}\} \leq 360$, an average grain size of the copper alloy material before the finish cold rolling process is 2.5 μm to 7.5 μm, circular or elliptical precipitates are present in the copper alloy material before the finish cold rolling process, and an average particle size of the precipitates is 4.0 nm to 25.0 nm, or a percentage of the number of precipitates having a particle size of 4.0 nm to 25.0 nm makes up 70% or more of the precipitates, the copper alloy sheet contains 4.5% by mass to 10.0% by mass of Zn, 0.40% by mass to 0.85% by mass of Sn, 0.01% by mass to 0.08% by mass of P, and either one or both of 0.005% by mass to 0.05% by mass of Co and 0.35% by mass to 0.85% by mass of Ni, with the remainder being Cu and unavoidable impurities, and

[Zn], [Sn], [P], [Co], and [Ni] satisfy a relationship of $11 \leq [Zn]+7 \times [Sn]+15 \times [P]+12 \times [Co]+4.5 \times [Ni] \leq 16$, wherein [Zn], [Sn], [P], [Co], and [Ni] represent the contents % by mass of Zn, Sn, P, Co, and Ni, respectively, and wherein when the content of Ni is 0.35% by mass to 0.85% by mass then a relationship: $8 \leq [Ni]/[P] \leq 40$ is satisfied.

5. A method of producing a copper alloy sheet, the method comprising: in this order, subjecting an ingot to a hot rolling process to obtain a copper alloy material;

subjecting the copper alloy material to a cold rolling process;

subjecting the copper alloy material to a recrystallization heat treatment process; and subjecting the copper alloy material to a finish cold rolling process, wherein a hot rolling initiation temperature of the hot rolling process is 800° C. to 940° C., and a cooling rate of the copper alloy material in a temperature region from a temperature after final rolling or 650° C. to 350° C. is 1° C./second or more, a cold working rate in the cold rolling process is 55% or more, the recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recrystallization heat treatment process, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and the cold working rate at the cold rolling process is set as RE (%), $550 \leq Tmax \leq 790$, $0.04 \leq tm \leq 2$, and $460 \leq \{Tmax-40 \times tm^{-1/2}-50 \times (1-RE/100)^{1/2}\} \leq 580$, an average grain size of the copper alloy material before the finish cold rolling process is 2.0 μm to 8.0 μm, circular or elliptical precipitates are present in the copper alloy material before the finish cold rolling process, and an average particle size of the precipitates is 4.0 nm to 25.0 nm, or a percentage of the number of precipitates having a particle size of 4.0 nm to 25.0 nm makes up 70% or more of the precipitates, the copper alloy sheet contains 4.5% by mass to 12.0% by mass of Zn, 0.40% by mass to 0.90% by mass of Sn, 0.01% by mass to 0.08% by mass of P, 0.004% by mass to 0.04% by mass of Fe, and either one or both of 0.005% by mass to 0.08% by mass of Co and 0.03% by mass to 0.85% by mass of Ni, with the remainder being Cu and unavoidable impurities,

[Zn], [Sn], [P], [Co], and [Ni] satisfy a relationship of $11 \leq [Zn]+7 \times [Sn]+15 \times [P]+12 \times [Co]+4.5 \times [Ni] \leq 17$, wherein [Zn], [Sn], [P], [Co], and [Ni] represent the contents % by mass of Zn, Sn, P, Co, and Ni, respectively, and

[Co] and [Fe] satisfy a relationship of $[Co]+[Fe] \leq 0.08$, where [Co] and [Fe] represent the contents % by mass of Co and Fe, respectively.

6. A method of producing a copper alloy sheet, the method comprising: in this order, subjecting an ingot to a hot rolling process to obtain a copper alloy material;

subjecting the copper alloy material to a cold rolling process;

subjecting the copper alloy material to a recrystallization heat treatment process;

subjecting the copper alloy material to a finish cold rolling process; and subjecting the copper alloy material to a recovery heat treatment process, wherein a hot rolling initiation temperature of the hot rolling process is 800° C. to 940° C., and a cooling rate of the copper alloy material in a temperature region from a temperature after final rolling or 650° C. to 350° C. is 1° C./second or more, a cold working rate in the cold rolling process is 55% or more, the recrystallization heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recrystallization heat treatment process, when the highest arrival temperature of the copper alloy material is set as Tmax (° C.), a retention time in a temperature range from a temperature lower than the highest arrival temperature of the copper alloy material by 50° C. to the highest arrival temperature is set as tm (min), and the cold working rate at the cold rolling process is set as RE (%), $550 \leq Tmax \leq 790$, $0.04 \leq tm \leq 2$, and $460 \leq \{Tmax-40 \times tm^{1/2}-50 \times (1-RE/100)^{1/2}\} \leq 580$, the recovery heat treatment process includes a heating step of heating the copper alloy material to a predetermined temperature, a retention step of retaining the copper alloy material at a predetermined temperature for a predetermined time after the heating step, and a cooling step of cooling down the copper alloy material to a predetermined temperature after the retention step, in the recovery heat treatment process, when the highest arrival temperature of the copper alloy material is set as Tmax2 (° C.), a retention time in a temperature range from a temperature lower than the highest arrival temperature of the copper alloy material by 50° C. to the highest arrival temperature is set as tm2 (min), and a cold working rate at the finish cold rolling process is set as RE2(%), $160 \leq Tmax2 \leq 650$, $0.02 \leq tm2 \leq 200$, and $100 \leq \{Tmax2-40 \times tm2^{-1/2}-50 \times (1-RE2/100)^{-1/2}\} \leq 360$, an average grain size of the copper alloy material before the finish cold rolling process is 2.0 μm to 8.0 μm, circular or elliptical precipitates are present in the copper alloy material before the finish cold rolling process, and an average particle size of the precipitates is 4.0 nm to 25.0 nm, or a percentage of the number of precipitates having a particle size of 4.0 nm to 25.0 nm makes up 70% or more of the precipitates, the copper alloy sheet contains 4.5% by mass to 12.0% by mass of Zn, 0.40% by mass to 0.90% by mass of Sn, 0.01% by mass to 0.08% by mass of P, 0.004% by mass to 0.04% by mass of Fe, and either one or both of 0.005% by mass to 0.08% by mass of Co and 0.03% by mass to 0.85% by mass of Ni, with the remainder being Cu and unavoidable impurities,

[Zn], [Sn], [P], [Co], and [Ni] satisfy a relationship of $11 \leq [Zn]+7\times[Sn]+15\times[P]+12\times[Co]+4.5\times[Ni] \leq 17$, wherein [Zn], [Sn], [P], [Co], and [Ni] represent the contents % by mass of Zn, Sn, P, Co, and Ni, respectively, and

[Co] and [Fe] satisfy a relationship of $[Co]+[Fe] \leq 0.08$, wherein [Co] and [Fe] represent the contents % by mass of Co and Fe, respectively.

* * * * *